US008337777B2

(12) United States Patent
Nurse et al.

(10) Patent No.: US 8,337,777 B2
(45) Date of Patent: Dec. 25, 2012

(54) SAMPLE DISTRIBUTION DEVICES AND METHODS

(75) Inventors: James C. Nurse, Pleasanton, CA (US); Douglas P. Greiner, Fremont, CA (US); Nigel P. Beard, Redwood City, CA (US)

(73) Assignee: Applied Biosystems, LLC, Carlsbad, CA (US)

( * ) Notice: Subject to any disclaimer, the term of this patent is extended or adjusted under 35 U.S.C. 154(b) by 773 days.

(21) Appl. No.: 11/768,138

(22) Filed: Jun. 25, 2007

(65) Prior Publication Data

US 2008/0003145 A1 Jan. 3, 2008

Related U.S. Application Data

(60) Provisional application No. 60/806,070, filed on Jun. 28, 2006.

(51) Int. Cl.
*B01L 3/00* (2006.01)

(52) U.S. Cl. ..... 422/503; 422/502; 422/504; 422/537; 137/15.06; 137/67

(58) Field of Classification Search ..... 422/99–100, 422/502–504, 537; 251/361; 137/15.06, 137/67

See application file for complete search history.

(56) References Cited

U.S. PATENT DOCUMENTS 5,045,082 A * 9/1991 Ayer et al. ..... 604/892.1
6,488,872 B1 * 12/2002 Beebe et al. ..... 264/31
2002/0127146 A1 * 9/2002 Bergh et al. ..... 422/89

OTHER PUBLICATIONS

Richter et al., "Influence of volume phase transition phenomena on the behavior of hydrogel-based valves," *Sensors and Actuators*, B99, 2004, pp. 451-458.

* cited by examiner

*Primary Examiner* — Jyoti Nagpaul

(57) ABSTRACT

A device and methods for sample distribution through a channel in which an expandable valve provides a mechanism to regulate flow through the channel. The valve may be configured to exert a force on a membrane layer so as to substantially block a portion of the channel to retain the sample in a desired location and prevent flow past the valve mechanism between the channel and a chamber.

47 Claims, 9 Drawing Sheets

SAMPLE DISTRIBUTION DEVICES AND METHODS

CROSS REFERENCE TO RELATED APPLICATIONS

This application claims a priority benefit under 35 U.S.C. §119(e) from U.S. Patent Application No. 60/806,070 filed Jun. 28, 2006, which is incorporated herein by reference.

FIELD

The present teachings relate to devices and methods for distributing a sample fluid. More specifically, the present teachings relate to devices and methods for distributing a biological sample for performing testing of the biological sample.

BACKGROUND

Biochemical testing for research and diagnostic applications can require simultaneous assays including a large number of analytes in conjunction with one or a few samples. Further, biochemical testing can include extended sample manipulation, multiple test substrates, multiple analytical instruments, and other steps. It may be desirable to analyze one or a few biological samples using a single test device with a large number of analytes while requiring a small amount of sample. It also may be desirable to load one or more biological samples into one or more sample chambers of a substrate and individually seal each chamber while performing a chemical reaction, such as, for example, a polymerase chain reaction (PCR) in the chamber and/or while otherwise processing the sample, including, for example, sample preparation.

Isolation (e.g., sealing) of biological sample and/or chemical assays within a substrate or other biological testing device may be desirable to perform chemical reactions and to avoid cross-contamination of various substances within a biological testing device, such as, for example, a microfluidic substrate which defines a network of sample distribution channels and chambers. Various techniques have been used to achieve sealing, for example, of channels and/or chambers of microfluidic substrates, including, for example, mechanically deforming a laminate layer of the substrate.

It may be desirable, however, to provide a mechanism for achieving sealing of chambers and/or channels in a microfluidic device that is reversible and/or selectively actuatable, which may thereby permit serialized processing and/or flow control of the sample, for example, within a microfluidic substrate for biological testing. It may further be desirable to provide a mechanism for achieving sealing that permits a closure force to be adjusted. Additionally, it may be desirable to provide a relatively inexpensive mechanism to achieve sealing that is relatively easy to manufacture.

Moreover, it may be desirable to provide a method and device that achieves valving (e.g., control over fluid flow) within a microfluidic device, for example, a microfluidic device for performing biochemical testing.

It also may be desirable to provide mechanisms that achieve sealing and/or valving that do not rely on mechanical and/or external actuation devices and/or that reduce wear.

SUMMARY

In various embodiments of the present teachings a device for distribution of a biological sample is provided, the device further comprising: a substrate comprising a base and a membrane layer, the substrate defining at least one sample chamber and at least one channel, the at least one sample chamber and the at least one channel being in flow communication to flow biological sample therebetween; at least one valve mechanism configured to expand from a first position to a second position, wherein, in the first position, the at least one valve mechanism permits flow communication between the at least one channel and the at least one sample chamber, and wherein, in the second position, the at least one valve mechanism is configured to exert a force on the membrane layer so as to substantially block a portion of the at least one channel to prevent the biological sample from flowing past the valve mechanism between the at least one channel and the at least one chamber.

In other embodiments, a method for distributing a biological sample is provided, the method further comprising: supplying the biological sample to a substrate comprising a base and a membrane layer, the substrate defining at least one sample chamber and at least one channel, the at least one sample chamber and the at least one channel being in flow communication to flow biological sample therebetween; expanding at least one valve mechanism from a first position, wherein the valve mechanism permits flow communication between the at least one channel and the at least one sample chamber, to a second position, wherein the at least one valve mechanism is configured to exert a force on the membrane layer so as to substantially block a portion of the at least one channel to prevent the biological sample from flowing past the valve mechanism between the at least one channel and the at least one chamber.

Exemplary embodiments according to teachings of the present disclosure may satisfy one or more of the above-mentioned desirable features set forth above. Other features and advantages will become apparent from the detailed description which follows.

Additional embodiments are set forth in part in the description that follows, and in part will be apparent from the description, or may be learned by practice of the various embodiments described herein.

BRIEF DESCRIPTION OF THE DRAWINGS

Various embodiments of the present teachings are exemplified in the accompanying drawings. The teachings are not limited to the embodiments depicted, and include equivalent structures and methods as set forth in the following description and known to those of ordinary skill in the art. In the drawings.

Figure 1A:
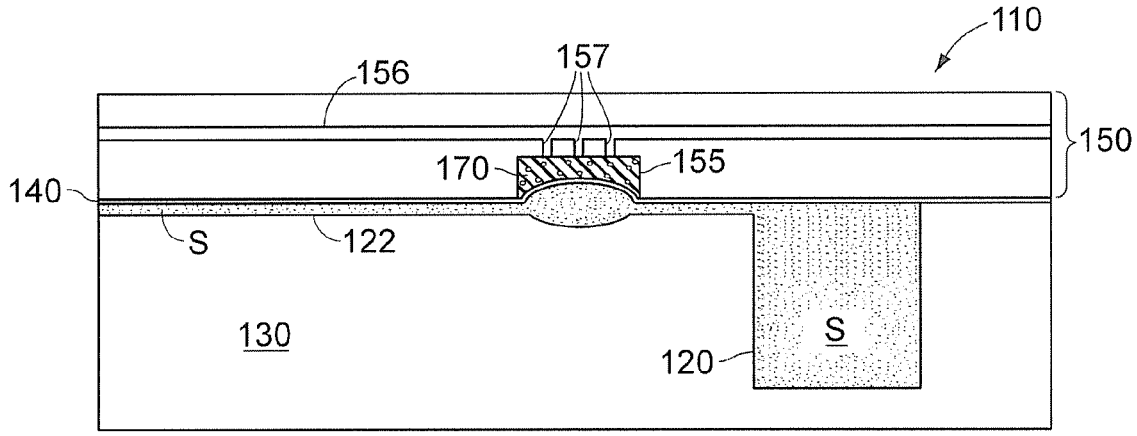
FIGS. 1A-1C illustrate a cross-sectional view of a substrate for biological analysis and various steps for sealing the substrate according to an exemplary embodiment of the present teachings.

It is to be understood that both the foregoing general description and the following detailed description are exemplary and explanatory only and are intended to provide a further explanation of the various embodiments of the present teachings.

DESCRIPTION OF VARIOUS EMBODIMENTS

In this application, the use of the singular includes the plural unless specifically stated otherwise. In this application, the use of "or" means "and/or" unless stated otherwise. Furthermore, the use of the term "including", as well as other forms, such as "includes" and "included", is not limiting. Also, terms such as "element" or "component" encompass both elements and components comprising one unit and elements and components that comprise more than one subunit unless specifically stated otherwise. Wherever possible, the same reference numbers will be used throughout the drawings to refer to the same or like parts.

The section headings used herein are for organizational purposes only, and are not to be construed as limiting the subject matter described. All documents cited in this application, including, but not limited to patents, patent applications, articles, books, and treatises, are expressly incorporated by reference in their entirety for any purpose.

Exemplary aspects of the disclosure provide a microfluidic device configured to be loaded with a biological sample for biological and/or chemical testing. According to various exemplary embodiments, the present invention may provide a device useful for testing one or more fluid samples for the presence, absence, and/or amount of one or more selected analytes. The sample may be a biological sample, for example, an aqueous biological sample, an aqueous solution, a slurry, a gel, a blood sample, a polymerase chain reaction (PCR) master mix, or any other type of sample.

According to various embodiments, a microfluidic device may include a substrate or body structure that has one or more microscale sample-support, manipulation, and/or analysis structures, such as one or more channels, wells, chambers, reservoirs, valves or the like disposed within it. As used herein, "microscale" or "micro" may describe a fluid channel, well, conduit, chamber, reservoir, or other structure configured to move or contain a fluid that has at least one cross-sectional dimension, e.g., width, depth or diameter, of less than about 1000 micrometers. In various embodiments, such structures have at least one cross-sectional dimension of no greater than 750 micrometers, and in some embodiments, from about 1 micrometer to about 500 micrometers (e.g., from about 5 micrometers to about 250 micrometers, or from about 5 micrometers to about 100 micrometers). In one embodiment, the at least one cross-sectional dimension may range from about 50 micrometers to about 150 micrometers. For example, the device shown in FIG. 1 may have microchannels with a cross-sectional area 60 μm×150 μm, and microchambers with the diameter of about 1960 μm and the depth of 500 μm.

With respect to chambers, for example, as may be found in a microfluidic card (microcard), chip (microchip), or tray (microtray) used in biological testing, "microscale" or "micro" as used herein, may describe structures configured to hold a small (e.g., micro) volume of fluid, e.g., no greater than about a few microliters. By way of example, the device shown in FIG. 1 may have microchambers with a volume of about 1.35 μL. In various embodiments, such chambers are configured to hold no more than 100 μl, no more than 75 μl, no more than 50 μl, no more than 25 μl, no more than 10 μl, or no more than 1 μl. In some embodiments, such chambers can be configured to hold, for example, from about 0.0001 μl to about 10 μl.

Although in exemplary aspects, it is envisioned that the present teachings may be suited to microfluidic devices having volumes in accordance with the various ranges discussed above, such volumes and sizes are exemplary only. Indeed, it is envisioned that the present teachings of expandable valve mechanisms and principles of operation of controlling fluid flow within a device according to various embodiments may apply to devices of other configurations and sizes, and including volumes for flowing and/or containing fluid ranging from picoliters to several liters.

A microfluidic device may be configured in any of a variety of shapes and sizes. In various embodiments, a microfluidic device can be generally rectangular, having a width dimension of no greater than about 15 cm (e.g., about 2, 6, 8 or 10 cm), and a length dimension of no greater than about 30 cm (e.g., about 3, 5, 10, 15 or 20 cm). In other embodiments, a microfluidic device can be generally square shaped. In still further embodiments, the microfluidic device can be generally circular (i.e., disc-shaped), having a diameter of no greater than about 35 cm (e.g., about 7.5, 11.5, or 30.5 cm). The disc can have a central hole formed therein, e.g., to receive a spindle (having a diameter, e.g., of about 1.5 or 2.2 cm). Other shapes and dimensions are contemplated herein, as well. In yet other embodiments, the microfluidic device may be in the form of a deformable tube.

The present teachings are well suited for microfluidic devices which typically include a system or device having channels, chambers, and/or reservoirs (e.g., a network of chambers connected by channels) for supporting or accommodating very small (micro) volumes of fluids, and in which the channels, chambers, and/or reservoirs have microscale dimensions.

The various sample-containment structures provided within a microfluidic device as set forth herein can take any shape including, but not limited to, a tube, a channel, a microfluidic channel, a vial, a cuvette, a capillary, a cube, an etched channel plate, a molded channel plate, an embossed channel plate, or other chamber. Such features can be part of a combination of multiple such structures grouped into a row, an array, an assembly, etc. Multi-chamber arrays within a microfluidic device can include 12, 24, 36, 48, 96, 192, 384, 768, 1536, 3072, 6144, 12,288, 24,576, or more, sample chambers, for example.

In various exemplary aspects, the device may include a substrate defining a sample-distribution network having a main fluid channel for supplying the sample throughout the device, one or more sample chambers (preferably a plurality of such chambers), one or more inlet branch channels providing flow communication between each of the one or more chambers and the main fluid channel, and one or more outlet branch channels in flow communication with the one or more sample chambers. In other embodiments, the sample chambers may be connected in series such that an outlet branch of one sample chamber serves as inlet branch to another sample chamber. In yet further embodiments, a substrate may include both sample chambers arranged in series and in parallel.

In various exemplary embodiments, the one or more sample chambers may be configured to receive an analyte-specific reagent effective to react with a selected analyte that may be present in a sample that fills the sample chamber. For example, fluorescent probes for amplification of specific nucleic acid targets may be used.

According to various embodiments, the substrate may also have, for each chamber, an optically transparent window through which analyte-specific reaction products can be detected, for example via fluorescence detection mechanisms. The detection mechanism may comprise a non-optical sensor for signal detection.

According to various embodiments, various types of valves can be arranged between the sample chambers and other channels, loading mechanisms, or sample chambers that may be included in or on the device. The valves can be selectively opened and closed to manipulate fluid movement through the device, for example, with the assistance of a centrifugal force or positive displacement.

It is contemplated that a variety of techniques may be used to fill the sample chambers and other sample-containment portions of the devices, according to various aspects. For example, filling the various sample-containment portions of the device may occur via centrifuging (e.g., spinning) the device to cause the sample or other liquid to move from, for example, fluid channels into sample chambers. Vacuum also may be used to cause the fluid in the device to move to and/or through various sample-containment portions. According to another exemplary aspect, positive pressure, applied, for example, via a syringe, pump, or compressor placed in flow communication with a sample-containment structure (e.g., a fluid inlet leading to a main fluid channel) of the device may be used to cause fluid to move throughout the network of sample containment structures in the device to desired portions of the device. In yet another exemplary aspect, capillary forces may be used to move the liquid to desired sample-containment structures of the device. Those having skill in the art would understand how to implement the various techniques discussed above to fill microfluidic devices. In each of the above configurations, venting channels and vents can be used to accommodate any displaced venting gas, whether air or other gas such as nitrogen that is pushed out by the sample, or the venting channels and vents can be used to evacuate the gas in the sample chambers to create a vacuum for the sample or aspirate sample itself.

The term "sample chamber" as used herein refers to any structure that provides containment to a sample, for example, for performing chemical reactions, testing, analysis, mixing (including, e.g., preparation) or other processing of the sample. The chamber can have any shape including circular, rectangular, cylindrical, etc. Multi-chamber arrays can include 12, 24, 36, 48, 96, 192, 384, 3072, 6144, or more sample chambers. The term "channel" as used herein refers to any structure that may be used to flow sample, for example, to or from a chamber. A channel can have any shape. It can be straight or curved, as necessary, with cross-sections that are shallow, deep, square, rectangular, concave, or V-shaped, or any other appropriate configuration.

The term "biological sample" as used herein refers to any biological or chemical substance, typically in an aqueous solution with luminescent dye that can produce emission light in relation to one or more nucleic acids present in the solution. The biological sample can include one or more nucleic acid sequences to be incorporated as a reactant in polymerase chain reaction (PCR) and other reactions such as, for example, ligase chain reactions, antibody binding reactions, oligonucleotide ligations assays, and hybridization assays. The biological sample can include one or more nucleic acid sequences to be identified for DNA sequencing.

In various embodiments, the channels (e.g., inlet and/or outlet channels) in flow communication with a sample chamber can be dimensioned to facilitate rapid delivery of sample to the sample chambers, while occupying as little volume as possible. For example, cross-sectional dimensions for the channels can range from 0.5 μm to 250 μm for both the width and depth. In some embodiments, the channel path lengths to the sample chambers can be minimized to reduce the total channel volume. For example, the network can be substantially planar, i.e., the sample introduction channels and sample chambers in the substrate may intersect in a common plane.

In various embodiments, the substrate that defines the sample-distribution network can be constructed from any solid material that is suitable for conducting analyte detection, such as, for example, optical fluorescent-based detection. Materials that can be used will include various plastic polymers and copolymers, such as polypropylenes, polystyrenes, polyimides, COP, COC, and polycarbonates. Inorganic materials such as glass and silicon are also useful. Silicon, in view of its high thermal conductivity, may facilitate rapid heating and cooling of the substrate if necessary. The substrate can be formed from a single material or from a plurality of materials.

In various embodiments, the sample-distribution network including cavities and trenches formed in the base of the substrate can be formed by any suitable method known in the art. Injection molding can be suitable to form sample cavities and connecting channels having a desired pattern. Standard etching, RIE, DRIE, and wet-etching techniques from the semiconductor industry can be used as known in the art of photo-lithography.

In various embodiments, the substrate can be prepared from two or more laminated layers that may be made from, for example, a detection-compatible material. The term detection-compatible material may refer to the optical detection with a substrate that includes one or more layers which provide optical transparency for each sample chamber, through which a luminescent dye can be detected, for example. For this purpose, silica-based glasses, quartz, polycarbonate, or an optically transparent plastic layer may be used, for example. Selection of the particular detection-compatible material depends in part on the optical properties of the material. For example, in luminescent dye-based assays, the material may exhibit low fluorescence emission at the wavelength(s) being measured. The detection-compatible material also may exhibit minimal light absorption for the signal wavelengths of interest.

In various embodiments, other layers in the substrate can be formed using the same or different materials. Such materials may be assay compatible so as to provide compatibility with the interaction of assay reagents and assay conditions (heat, pressure, pH, etc.) with the substrate material (hydrophobic, hydrophilic, inert, etc.). For example, the layer or layers, such as a film or membrane layer defining the sample chambers can be formed predominantly from a material that has high heat conductivity, such as silicon or a heat-conducting metal. The silicon surfaces that contact the sample can be coated with an oxidation layer or other suitable coating, to render the surface more inert and make it an assay-compatible material. Similarly, where a heat-conducting metal is used in the substrate, the metal can be coated with an assay-compatible material, such as a plastic polymer, to prevent corrosion of the metal and to separate the metal surface from contact with the sample. The suitability of a particular surface may be verified for the selected assay as known by the conditions and reagents used in the assay.

According to various embodiments, a membrane layer used to at least partially define a sample containment portion of a microfluidic device may be deformable and/or preformed and may be configured so as to isolate the valve mechanisms described herein from the biological sample and/or other chemistry contained in the sample containment portion. Suitable deformable membrane materials may include, for example, elastomers that are compatible with the chemistries (e.g. biological samples and/or assays) contained in the microfluidic device, including, but not limited to, polydimethylsiloxanes (PDMS) or polyurethanes. Examples of suitable preformed membrane materials, include, but are not limited to, for example polypropylene, and the expanded shape of the membrane may be molded into the film material before assembly.

In various embodiments, the substrate layers can be sealably bonded in a number of ways. A suitable bonding substance, such as a glue or epoxy-type resin, can be applied to one or both opposing surfaces that will be bonded together. The bonding substance may be applied to the entirety of either surface, so that the bonding substance (after curing) can come into contact with the sample chambers and the distribution network. In this case, the bonding substance is selected to be compatible with the sample and detection reagents used in the assay. Alternatively, the bonding substance can be applied around the distribution network and detection chambers so that contact with the sample can be minimal or avoided entirely. The bonding substance may also be provided as part of an adhesive-backed tape or membrane, which is then brought into contact with the opposing surface. In yet another approach, the sealable bonding is accomplished using an adhesive gasket layer, which is placed between the two substrate layers. In any of these approaches, bonding may be accomplished by any suitable method, including pressure-sealing, ultrasonic welding, and heat curing, for example.

In various embodiments, a pressure-sensitive adhesive (PSA) can be used in constructing the microfluidic device, for example, the membrane layer. PSA films which can be applied to a surface and adhered to that surface are obtained by applying pressure to the film. Normally pressure is applied throughout the whole film, so that the whole film can adhere to the surface. PSA films can have threshold pressure was in order to activate the adhesion. These can be very low. By applying pressure to some selected regions, the bonding can be limited to those regions only, thus allowing for obtaining a bonding pattern. In this way, channels and chambers can be defined. The elastic properties of the film can then be used to pressure-drive a fluid through the unbonded regions, since the film would deform under the liquid pressure, thus opening up a channel. PSA films can have hydrophobic and hydrophilic areas on the same film to provide areas of differing wetting characteristics, properly patterned, to provide, for example fluid flow in sample introduction channels and gas venting in venting channels. In various embodiments, PSA films that are hydrophilic can have the hydrophilic properties deteriorate in a matter of days. The lack of stability (hydrophilic film turning into hydrophobic) can provide controllable, irreversible or reversible, changes (upon temperature change, heat addition, UV exposure, or just time delay after curing) in the wetting nature of the film. In various embodiments, PSA films can have different porosities and permeabilities to a gas. A highly permeable PSA film can be more advantageous than a low-permeability one for instance to vent the sample chambers. Further, a PSA film whose permeability/porosity can be modified in a reversible fashion with temperature change, and/or in an irreversible fashion by heat addition or UV exposure can be used to distribution and then sealed to processing. In various embodiments, PSA films can have hydrophilic, provide solvent resistance, maintain the adhesion characteristics at a high temperature (95-100 degree Celsius), and can be optically clear with low auto-fluorescence. In various embodiments, PSA films can be thermally expandable to swell at desired locations and close off channels.

In various embodiments, microfluidic devices, including substrates, in accordance with exemplary embodiments of the present teaching can be adapted to allow rapid heating and cooling of the sample chambers to facilitate reaction of the sample with the analyte-detection reagents, including luminescent dyes. In one embodiment, the device can be heated or cooled using an external temperature-controller. The temperature-controller may be adapted to heat/cool one or more surfaces of the device, or can be adapted to selectively heat the sample chambers themselves. To facilitate heating or cooling with this embodiment, the substrate can be formed of a material that has high thermal conductivity, such as copper, aluminum, or silicon. Alternatively, the substrate base can be formed from a material having moderate or low thermal conductivity, while the membrane layer can be formed form a conductive material such that the temperature of the sample chambers can be conveniently controlled by heating or cooling the substrate through the film, regardless of the thermal conductivity of the base. For example, the membrane layer can be formed of an adhesive copper-backed tape.

In various embodiments, sample chambers and/or other sample-containment portions can be pre-loaded with detection reagents that are specific for the selected analytes of interest. For example, the sample chambers may contain a dried reagent. The detection reagents can be designed to produce an optically detectable signal via any of the optical methods known in the field of detection. It will be appreciated that although the reagents in each sample chamber can contain substances specific for the analyte(s) to be detected in the particular chamber, other reagents for production of the optical signal for detection can be added to the sample prior to loading, or may be placed at locations elsewhere in the network for mixing with the sample. Whether particular assay components are included in the detection chambers or elsewhere will depend on the nature of the particular assay, and on whether a given component is stable to drying. Pre-loaded reagents added in the detection chambers during manufacture of the substrate can enhance assay uniformity and minimize the assay steps conducted by the end-user.

In various embodiments, the sample can require sample preparation prior to introduction into the microfluidic device. A raw biological sample from a syringe can be injected into a fluidic cartridge that provides the sample preparatory reagents and/or separation and then mates directly with the substrate. Such a cartridge integrates the sample preparation and sample introduction into the substrate. The cartridge can also introduce the other reagents for production of the optical signal discussed above.

In various embodiments, the analyte to be detected may be any substance whose presence, absence, or amount is desirable to be determined. The detection means can include any reagent or combination of reagents suitable to detect or measure the analyte(s) of interest. It will be appreciated that more than one analyte can be tested for in a single detection chamber, if desired.

In one embodiment, the analytes are selected-sequence polynucleotides, such as DNA or RNA, and the analyte-specific reagents include sequence-selective reagents for detecting the polynucleotides. The sequence-selective reagents include at least one binding polymer that is effective to selectively bind to a target polynucleotide having a defined sequence. The binding polymer can be a conventional polynucleotide, such as DNA or RNA, or any suitable analog thereof, which has the requisite sequence selectivity. Other examples of binding polymers known generally as peptide nucleic acids may also be used. The binding polymers can be designed for sequence specific binding to a single-stranded target molecule through Watson-Crick base pairing, or sequence-specific binding to a double-stranded target polynucleotide through Hoogstein binding sites in the major groove of duplex nucleic acid. A variety of other suitable polynucleotide analogs are also known in the art of nucleic acid amplification. The binding polymers for detecting polynucleotides are typically 10-30 nucleotides in length, with the exact length depending on the requirements of the assay, although longer or shorter lengths are also contemplated.

In one embodiment, the analyte-specific reagents include an oligonucleotide primer pair suitable for amplifying, by polymerase chain reaction, a target polynucleotide region of the selected analyte that is flanked by 3'-sequences complementary to the primer pair. In practicing this embodiment, the primer pair is reacted with the target polynucleotide under hybridization conditions which favor annealing of the primers to complementary regions of opposite strands in the target. The reaction mixture is then thermal cycled through several, and typically about 20-40, rounds of primer extension, denaturation, and primer/target sequence annealing, according to well-known polymerase chain reaction (PCR) methods. Typically, both primers for each primer pair are pre-loaded in each of the respective sample chambers, along with the standard nucleotide triphosphates, or analogs thereof, for primer extension (e.g., ATP, CTP, GTP, and TTP), and any other appropriate reagents, such as MgCl2 or MnCl2. A thermally stable DNA polymerase, such as Taq, Vent, or the like, may also be pre-loaded in the chambers, or may be mixed with the sample prior to sample loading. Other reagents may be included in the detection chambers or elsewhere as appropriate. Alternatively, the detection chambers may be loaded with one primer from each primer pair, and the other primer (e.g., a primer common to all of sample chambers) can be provided in the sample or elsewhere. If the target polynucleotides are single-stranded, such as single-stranded DNA or RNA, the sample is preferably pre-treated with a DNA- or RNA-polymerase prior to sample loading, to form double-stranded polynucleotides for subsequent amplification. This pre-treatment can be provided in the cartridge.

In various embodiments, the presence and/or amount of target polynucleotide in a sample chamber, as indicated by successful amplification, is detected by any suitable means. For example, amplified sequences can be detected in double-stranded form by including an intercalating or crosslinking dye, such as ethidium bromide, acridine orange, or an oxazole derivative, for example, which exhibits a fluorescence increase or decrease upon binding to double-stranded nucleic acids. The level of amplification can also be measured by fluorescence detection using a fluorescently labeled oligonucleotide. In this embodiment, the detection reagents include a sequence-selective primer pair as in the more general PCR method above, and in addition, a sequence-selective oligonucleotide (FQ-oligo) containing a fluorescer-quencher pair. The primers in the primer pair are complementary to 3' regions in opposing strands of the target analyte segment which flank the region which is to be amplified. The FQ-oligo is selected to be capable of hybridizing selectively to the analyte segment in a region downstream of one of the primers and is located within the region to be amplified. The fluorescer-quencher pair can include a fluorescer dye and a quencher dye which are spaced from each other on the oligonucleotide so that the quencher dye is able to significantly quench light emitted by the fluorescer S at a selected wavelength, while the quencher and fluorescer are both bound to the oligonucleotide. The FQ-oligo preferably includes a 3'-phosphate or other blocking group to prevent terminal extension of the 3' end of the oligo. The fluorescer and quencher dyes may be selected from any dye combination having the proper overlap of emission (for the fluorescer) and absorptive (for the quencher) wavelengths while also permitting enzymatic cleavage of the FQ-oligo by the polymerase when the oligo is hybridized to the target. Suitable dyes, such as rhodamine and fluorscein derivatives, and methods of attaching them, are well known in the art of nucleic acid amplification.

In another embodiment, the detection reagents include first and second oligonucleotides effective to bind selectively to adjacent, contiguous regions of a target sequence in the selected analyte, and which can be ligated covalently by a ligase enzyme or by chemical means as known in the art of oligonucleotide ligation assay, (OLA). In this approach, the two oligonucleotides (oligos) can be reacted with the target polynucleotide under conditions effective to ensure specific hybridization of the oligonucleotides to their target sequences. When the oligonucleotides have base-paired with their target sequences, such that confronting end subunits in the oligos are base-paired with immediately contiguous bases in the target, the two oligos can be joined by ligation, e.g., by treatment with ligase. After the ligation step, the sample chambers may be heated to dissociate unligated probes, and the presence of ligated, target-bound probe is detected by reaction with an intercalating dye or by other means. The oligos for OLA may also be designed so as to bring together a fluorescer-quencher pair, as discussed above, leading to a decrease in a fluorescence signal when the analyte sequence is present. In the above OLA ligation method, the concentration of a target region from an analyte polynucleotide can be increased, if necessary, by amplification with repeated hybridization and ligation steps. Simple additive amplification can be achieved using the analyte polynucleotide as a target and repeating denaturation, annealing, and ligation steps until a desired concentration of the ligated product is achieved.

In another embodiment, the ligated product formed by hybridization and ligation can be amplified by ligase chain reaction (LCR). In this approach, two sets of sequence-specific oligos are employed for each target region of a double-stranded nucleic acid. One probe set includes first and second oligonucleotides designed for sequence-specific binding to adjacent, contiguous regions of a target sequence in a first strand in the target. The second pair of oligonucleotides is effective to bind (hybridize) to adjacent, contiguous regions of the target sequence on the opposite strand in the target. With continued cycles of denaturation, reannealing and ligation in the presence of the two complementary oligo sets, the target sequence is amplified exponentially, allowing small amounts of target to be detected and/or amplified.

In various embodiments, it will be appreciated that since the selected analytes in the sample can be tested for under substantially uniform temperature and pressure conditions, it may be desirable that the detection reagents in the various sample chambers have substantially the same reaction kinetics. This can be accomplished using oligonucleotides and primers having similar or identical melting curves, which can be determined by empirical or experimental methods as are known in the art. In another embodiment, the analyte is an antigen, and the analyte-specific reagents in each detection chamber include an antibody specific for a selected analyte-antigen. Detection may be by fluorescence detection, agglutination, or other homogeneous assay format. As used herein, "antibody" is intended to refer to a monoclonal or polyclonal antibody, an Fc portion of an antibody, or any other kind of binding partner having an equivalent function. For fluorescence detection, the antibody may be labeled with a fluorescer compound such that specific binding of the antibody to the analyte is effective to produce a detectable increase or decrease in the compound's fluorescence, to produce a detectable signal (non-competitive format). In an alternative embodiment (competitive format), the detection means includes (i) an unlabeled, analyte-specific antibody, and (ii) a fluorescer-labeled ligand which is effective to compete with the analyte for specifically binding to the antibody. Binding of the ligand to the antibody is effective to increase or decrease the fluorescence signal of the attached fluorescer. Accordingly, the measured signal can depend on the amount of ligand that is displaced by analyte from the sample. In a related embodiment, when the analyte is an antibody, the analyte-specific detection reagents include an antigen for reacting with a selected analyte antibody which may be present in the sample. The reagents can be adapted for a competitive or non-competitive type format, analogous to the formats discussed above. Alternatively, the analyte-specific reagents can include a mono- or polyvalent antigen having one or more copies of an epitope which is specifically bound by the antibody-analyte, to promote an agglutination reaction which provides the detection signal.

In various embodiments, the selected analytes can be enzymes, and the detection reagents include enzyme substrate molecules which are designed to react with specific analyte enzymes in the sample, based on the substrate specificities of the enzymes. Accordingly, sample chambers in the device may each contain a different substrate or substrate combination, for which the analyte enzyme(s) may be specific. This embodiment is useful for detecting or measuring one or more enzymes which may be present in the sample, or for probing the substrate specificity of a selected enzyme. Examples of detection reagents include chromogenic substrates such as NAD/NADH, FAD/FADH, and various other reducing dyes, for example, useful for assaying hydrogenases, oxidases, and enzymes that generate products which can be assayed by hydrogenases and oxidases. For esterase or hydrolase (e.g., glycosidase) detection, chromogenic moieties such as nitrophenol may be used, for example.

In various embodiments, the analytes are drug candidates, and the detection reagents include a suitable drug target or an equivalent thereof, to test for binding of the drug candidate to the target. It will be appreciated that this concept can be generalized to encompass screening for substances that interact with or bind to one or more selected target substances. For example, the assay device can be used to test for agonists or antagonists of a selected receptor protein, such as the acetylcholine receptor. In a further embodiment, the assay device can be used to screen for substrates, activators, or inhibitors of one or more selected enzymes. The assay may also be adapted to measure dose-response curves for analytes binding to selected targets.

For further details on exemplary embodiments and configurations of microfluidic devices for biological testing with which the exemplary sealing and/or valving techniques may be utilized, reference is made to U.S. application Ser. No. 11/380,327, filed Apr. 26, 2006, having the same assignee, and entitled "Systems and Methods for Multiple Analyte Detection," the entire disclosure of which is incorporated by reference herein. It should be understood, however, that the devices described in that application are exemplary only and that the present teachings are useful in combination with a variety of devices configured to distribute a fluid throughout a distribution network of channels and/or chambers within the device. Such devices may include those useful in a variety of applications other than biological testing, such as, for example, Reference will now be made to various exemplary embodiments, examples of which are illustrated in the accompanying drawings. Wherever possible, the same reference numbers are used in the drawings and the description to refer to the same or like parts.

Figure 7:
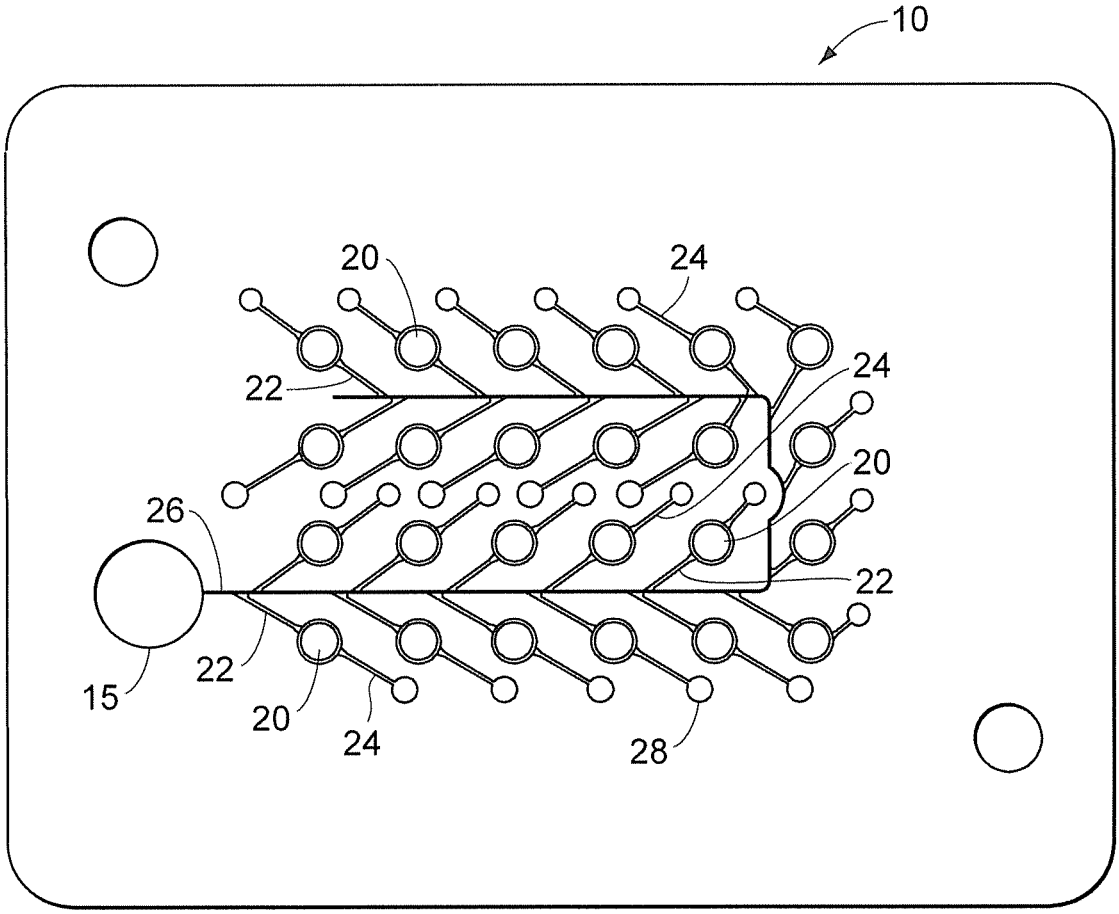
FIG. 7 illustrates a perspective view of a substrate for biological sample testing according to an exemplary embodiment of the present teachings.

FIG. 7 shows an exemplary embodiment of a microfluidic device 10 that may be used for biological testing. When filling a microfluidic device, such as that exemplified in FIG. 7, the sample fluid may be supplied via an inlet 15 to a main fluid channel 26 from where it travels into a plurality of inlet branch channels 22 leading to a plurality of sample chambers 20. In various exemplary aspects, a syringe, pump, or other positive pressure mechanism may be used to supply the sample to the inlet 15 and fill the microfluidic device 10. However, as mentioned above, other filling mechanisms may also be used. Typically, the sample fluid fills the sample chambers 20 and exits from outlet branch channels 24 leading from each chamber 20. In various embodiments, the outlet branch channels 24 may be in flow communication with vent chambers 28, and venting of displaced gas may occur by any of the techniques describe in U.S. application Ser. No. 11/380,327, incorporated by reference herein.

According to various exemplary embodiments, the device 10 can be in the form of a substrate that includes a base in which the various channels and chambers are defined and other layers. For example, the base may be formed via etching and/or injection molding, and a membrane (film) layer may cover the base to define the various sample containment portions of the substrate (e.g., the channels 22, 24, and 26, and the chambers 20 and 28. The film layer may be made of, for example, a pressure sensitive adhesive (PSA) film, laminated to the device so as to cover and seal fluid in the channels and chambers from leaking out of the device. In addition, one or more gas-permeable membranes and/or vent holes provided in a film layer may be provided. As discussed above, the membrane (film) layer may be made of any deformable material that is configured to isolate the valve mechanism material, described in further detail below, from the chemistries contained in the various channels and chambers of the device 10.

As will be described further below, the substrate may also include one or more additional layers, for example, defining various reservoirs and/or channels. The one or more additional layers may be positioned on an opposite side of the film layer as the base.

FIG. 7 represents one exemplary embodiment of a microfluidic device that may be used to perform biochemical testing, however, those skilled in the art would recognize various other configurations of such devices that may be used in conjunction with the present teachings. As discussed above, other microfluidic device configurations may include differing arrangements and/or number of sample chambers. For example, groups of sample chambers may be in parallel flow communication with a main sample supply channel or differing sample supply channels and may be supplied with sample via the same or differing fluid supply inlets. In the case of differing fluid supply inlets being in flow communication with differing groups of chambers, differing types of sample may be supplied to the differing groups within the microfluidic device. As further discussed above, the number of sample chambers may vary from that shown in FIG. 7.

As discussed above, once the sample chambers of a substrate have been filled, it may be desirable to seal filled chambers from flow communication with each other and the various sample distribution channels. In other words, it may be desirable to prevent sample from flowing out of or into one or more sample chambers via channels that are in flow communication with the one or more chambers. Such sealing may be desirable, for example, before various performing various processes on the sample within the chambers, such as, for example, PCR, and to prevent cross-contamination between sample chambers and/or other sample containment portions of the device. It also may be desirable to provide a mechanism for sealing that is relatively easily performed by a user of the biological testing device. Further, it may be desirable to provide a mechanism for sealing the substrate that does not require the use of sensors, heaters, and/or other components that may be relatively difficult and costly to implement.

It also may be desirable to provide flow control of the biological sample through the substrate. For example, it may be desirable to prevent the sample from flowing past a predetermined location in the sample distribution network and/or to move the sample from one location (e.g., sample containment portion) to another location (e.g., sample containment portion) within the device, as will be explained further below.

According to various exemplary embodiments, sealing of the chambers and/or controlling the flow of sample through the sample distribution network may occur through the use of expandable valve mechanisms. Such expandable valve mechanisms may be formed as part of the device and may include, for example, materials that swell upon contact with a fluid, such as, for example, water, a solvent, or the like. Examples of suitable materials for this use include polymers (e.g., swellable polymers), such as, for example, polyacrylamide. The fluid used to swell the expandable valve material may include, for example, water or other hydrating solution, including, for example a high pH solution or a low pH solution.

In some cases, as will be understood from the description of various exemplary embodiments that follows, it may be desirable to contact the valve mechanisms herein with a dehydrating solution, such as, for example, alcohol, in order to contract (shrink) the valve mechanism. This may permit reversible expansion of the valve mechanism. On the other hand, in some case, it may be desirable to prevent and/or hinder the expandable valve mechanisms from contracting once expanded. Thus, according to various embodiments, the valve mechanism material may include a cross-linking agent together with polyacrylamide. The application of a stimulus, such as, for example, heat, may be used to fix the valve material in its expanded state and prevent and/or hinder dehydration and/or decreases in the volume of the valve mechanism once expanded.

Figure 1B:
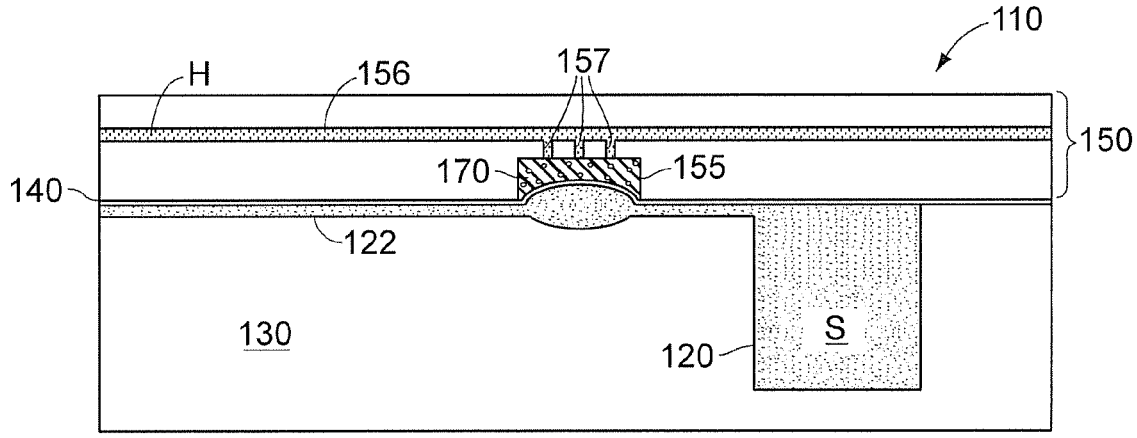

With reference to FIGS. 1A-1B, a cross-sectional schematic view of an exemplary embodiment of a substrate 110 is shown. The substrate 110 includes a base 130 defining various features (e.g., cavities, troughs, etc.) that may be formed in the base via etching or molding (e.g., injection molding), for example. The substrate 110 may further include a membrane layer 140 that covers the base 130 and, together with the features of the base, define a sample distribution network that may include a sample chamber 120 and a channel 122 in flow communication with the sample chamber 120. Channel 122 may be, for example, an inlet channel for flowing a biological sample fluid supplied to the device 110 to the sample chamber 120. The membrane layer 140 may be configured to prevent fluid that is supplied to the channels and chambers of the substrate from leaking out of the device, while also being capable of deforming to some degree to allow for pressure increases that may occur during filling and/or distributing fluid throughout the substrate 110.

Figure 1C:
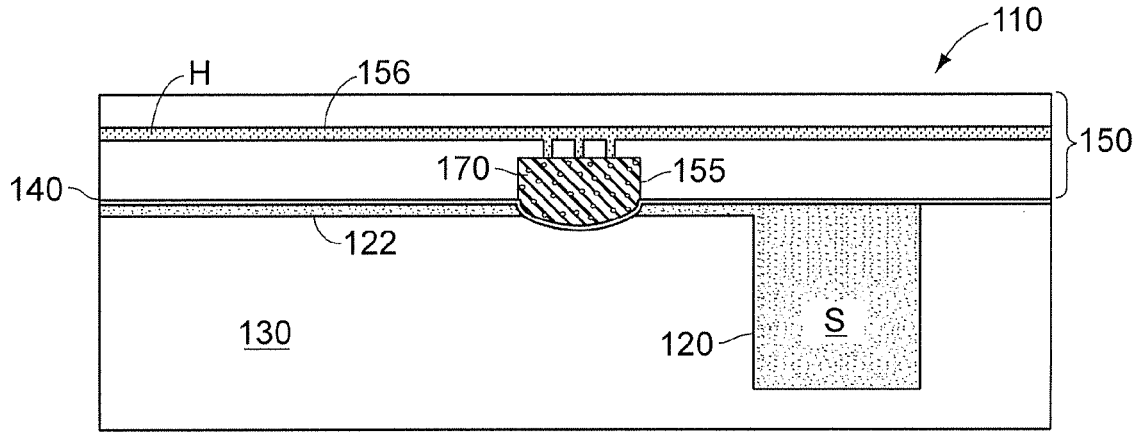

The substrate 110 may include an additional layer 150 disposed on a side of the membrane layer 140 opposite to the side on which the base 130 is disposed. The additional layer 150 also may define various features (e.g., cavities, troughs, channels, reservoirs etc.) formed, for example, via molding (e.g., injection molding) or etching. As depicted in FIGS. 1A-1C, the additional layer 150 together with the membrane layer 140 may define a reservoir 155. The additional layer 150 also may define a channel 156 in flow communication with the reservoir 155. By way of example, in the embodiment of FIGS. 1A-1C, the channel 156 may run through a thickness of the additional layer 150 and may be spaced (e.g., vertically as shown in FIGS. 1A-1C) from the reservoir 155. The channel 156 may be in flow communication with the reservoir 155 through one or more branch channels 157 leading from the channel 156 to the reservoir 155. In other embodiments, however, it is envisioned that the channel 156 may be in flow communication with the reservoir 155 via other arrangements. For example, the channel 156 could intersect the reservoir 155. Further, the channel 156 need not extend the entire length of the substrate 110 but instead could emanate from the feed channels 157 and/or the reservoir 155 and have any length.

The reservoir 155 may contain an expandable valve mechanism 170. For example, the reservoir 155 may contain a material configured to expand (e.g., swell) upon contact with a substance. The expandable material may be a hydrogel, a polymer, such as, for example, polyacrylamide or other suitable polymer, or other material configured to swell upon contact with a substance, such as, for example, water. Prior to expansion, the valve mechanism 170 may be contained in the reservoir 155 such that it is external to the channel 122, as shown in FIG. 1A, for example. Upon sufficient expansion of the valve mechanism 170, however, the valve mechanism 170 may expand so as to deform the membrane layer 140 and increase the volume of the reservoir 155 defined by the additional layer and the membrane layer 140. The expansion of the valve mechanism 170 and consequent deforming of the membrane layer 140 may be such that the valve mechanism 170 and membrane layer 140 enter a portion of the channel 122, as shown in FIG. 1C, for example. This entry into the portion of the channel 122 may be sufficient to substantially block the channel 122, thereby preventing flow communication between the channel 122 and the sample chamber 120 past the valve mechanism 170 so as to seal (e.g., isolate) the sample chamber 120.

As depicted in FIGS. 1A-1C, the portion of the channel 122 into which the valve mechanism 170 enters upon expansion may be provided with an enlarged cross-section. Exemplary steps that may be used to fill the sample chamber 120 with biological sample and then seal the sample chamber 120, for example, in order to perform processing of the biological sample, will now be described with reference to FIGS. 1A-1C. In FIG. 1A, a biological sample S may be supplied to the substrate 110, for example, via an inlet port or other inlet mechanism (not shown). The sample S may flow into the channel 122 and, from the channel 122, into the sample chamber 120 until the sample chamber 120 is filled with a desired amount of the sample S. During the filling of the sample chamber 120, the valve mechanism 170 may be in a nonexpanded (e.g., contracted) configuration such that it does not deform the membrane layer 140 and lies substantially external to the channel 122, as shown in FIG. 1A. As discussed above, various techniques, such as, positive pressure, vacuum, centrifugation, capillary forces, etc. may be used to flow the sample S through the substrate 110 and fill the sample chamber 120.

Once the sample chamber 120 has been filled with a desired amount of the sample S, a substance H, such as water or a solvent, for example, configured to expand the material of which the valve mechanism 170 is made may be supplied to the channel 156. The substance H may be supplied via an inlet port or other inlet structure (not shown) that is in flow communication with the channel 156 or may be directly supplied into the channel 156, for example, if the channel 156 opens to an external portion of the device. As with the filling of the substrate 110 with the biological sample, a variety of filling techniques, including, but not limited to, positive pressure, vacuum, centrifugation, capillary forces, etc. may be used to flow the substance H through the channel 156 and channels 157 into the reservoir 155. According to various embodiments, the substance H may flow through the channels 156 and 157 substantially at ambient pressure so as to avoid pressurization of the membrane layer 140. The channel 156 thus serves as a hydration channel to supply the substance H to the reservoir 155 and into contact with the material that forms the expandable valve mechanism 170.

Upon the substance H contacting the expandable valve mechanism 170, the material of the valve mechanism 170 increases in volume (e.g., expands). This expansion creates a pressure on the deformable membrane layer 140, allowing the membrane layer 140 and the valve mechanism 170 to enter a portion of the channel 122 that is substantially aligned with the reservoir 155, as illustrated in FIG. 1C. With sufficient expansion of the valve mechanism 170, the channel 122 becomes substantially blocked such that biological sample S is prevented from flowing past the portion of the channel blocked by the valve mechanism 170 between the sample chamber 120 and the channel 122, thereby sealing the sample chamber 120.

It is envisioned that the closure force of the valve mechanism 170 may be modified as desired by, for example, selecting differing types of expandable materials for the valve mechanism 170, such as, for example, materials having differing physio-chemical properties, altering the shape and/or form of the material, altering the shape and/or size of the reservoir 155, and/or contacting the valve mechanism 170 with differing substances to expand the valve mechanism to differing degrees.

Figure 2A:
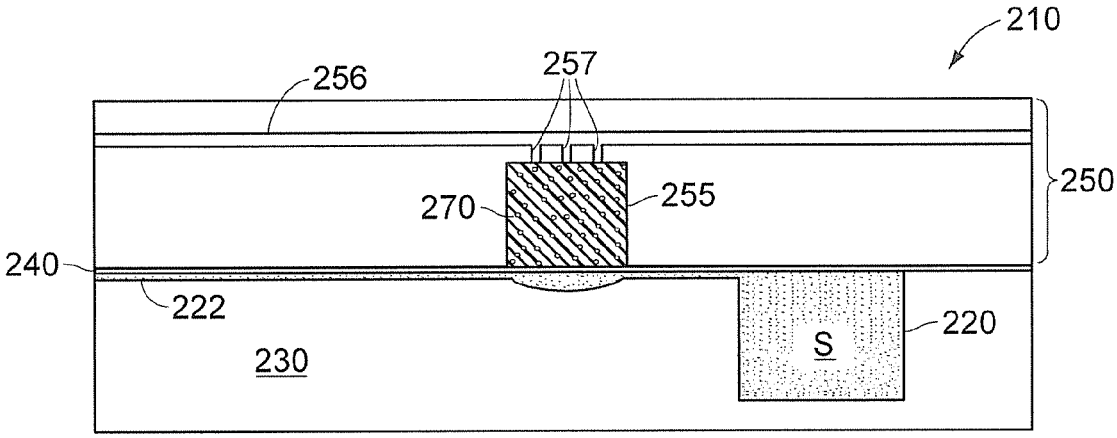
FIGS. 2A-2C illustrate a cross-sectional view of another substrate for biological analysis and various steps for sealing the substrate according to an exemplary embodiment of the present teachings.
Figure 2B:
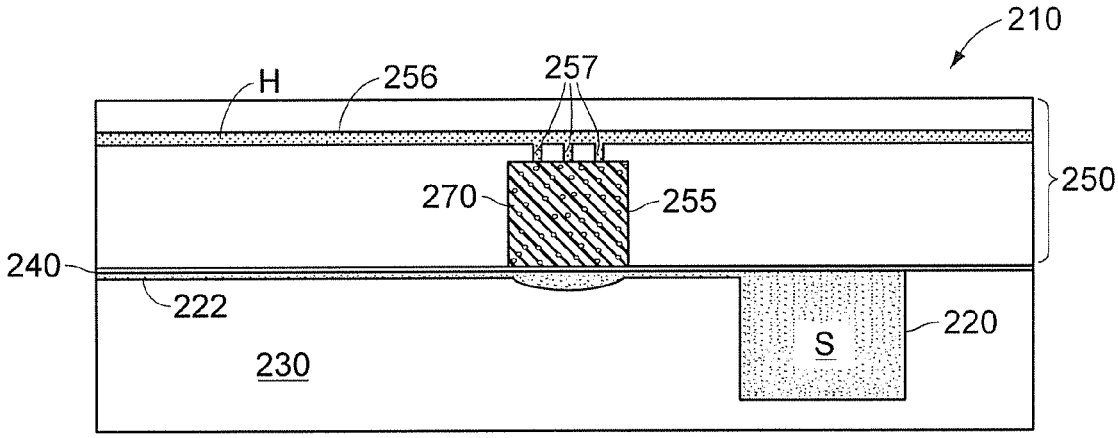
Figure 2C:
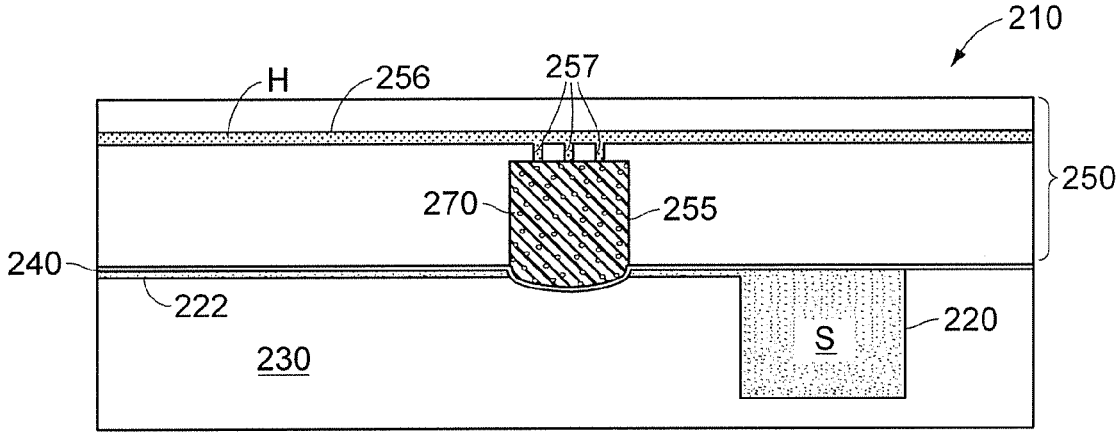

FIGS. 2A-2C depict an exemplary embodiment of a substrate 210 having a base 230 and a membrane layer 240 similar to the embodiment of FIGS. 1A-1C with the exception that the reservoir 255 formed in the additional layer 250 has a volume larger than the reservoir 155. Because the reservoir 255 is relatively large, a relatively large volume of expandable material can be placed in the reservoir 255 to form the valve mechanism 270. In the exemplary embodiment of FIGS. 2A-2C, upon contacting the substance H via the channels 256 and 257 with the valve mechanism 270 in the reservoir 255, as shown in FIGS. 2A and 2C, the material of the valve mechanism 270 may expand to a relatively larger volume than in the case of the exemplary embodiment of FIGS. 1A-1C. Due to this larger volume of the valve mechanism 270 upon expansion, the valve mechanism 270 may exert a larger force upon the membrane layer 240 to block the portion of the channel 222 and seal the chamber 220, as shown in FIG. 2C. Further, the valve mechanism 270 and reservoir 255 have a relatively large area that blocks the channel 222, which also results in a relatively large closure force.

In various embodiments, it also is envisioned that the valve mechanisms 170 and 270 may be contracted after expansion so as to unblock the channels 122 and 222 and permit flow communication between the channels 122 and 222 and the sample chambers 120 and 220. In such case, another substance configured to contract the material forming the valve mechanism 170 and 270 may be introduced into the reservoirs 155 and 255 and into contact with the valve mechanisms 170 and 270. By way of example, the substance for contracting the material of the valve mechanisms 170 and 270 may include alcohol and/or a solvent.

In various embodiments, the substance H used to expand the valve mechanisms 170 and 270 may be evacuated from the channels 156, 157, 256 and 257 and the substance configured to contract the valve mechanisms 170 and 270 may be introduced into reservoirs 155 and 255 via the channels 156, 157, 256, and 257. Alternatively, one or more separate channels (not shown) may be provided in the additional layers 150 and 250 and used to flow the contracting substance into contact with the valve mechanisms 170 and 270.

Thus, once a desired processing of the sample in the sample chambers 120 and 220 is completed and isolation of the sample chambers 120 is no longer needed and/or desired, the valve mechanisms 155 and 255 may be contracted substantially to occupy their original volume, as depicted in FIGS. 1A and 2A, and the sample S can again move throughout the devices 110 and 210. This reversible expansion and contraction of the valve mechanisms 170 and 270, therefore, permits control over the fluid flow throughout the substrate, as desired. As will be explained in more detail below, the ability to reversibly and selectively actuate the valve mechanisms in accordance with the present teachings may permit for sequential sample processing, including, for example, the ability to perform differing processes (including tests, reactions, assays, sample preparation, etc.) on the same or differing biological samples within the same substrate.

Figure 3A:
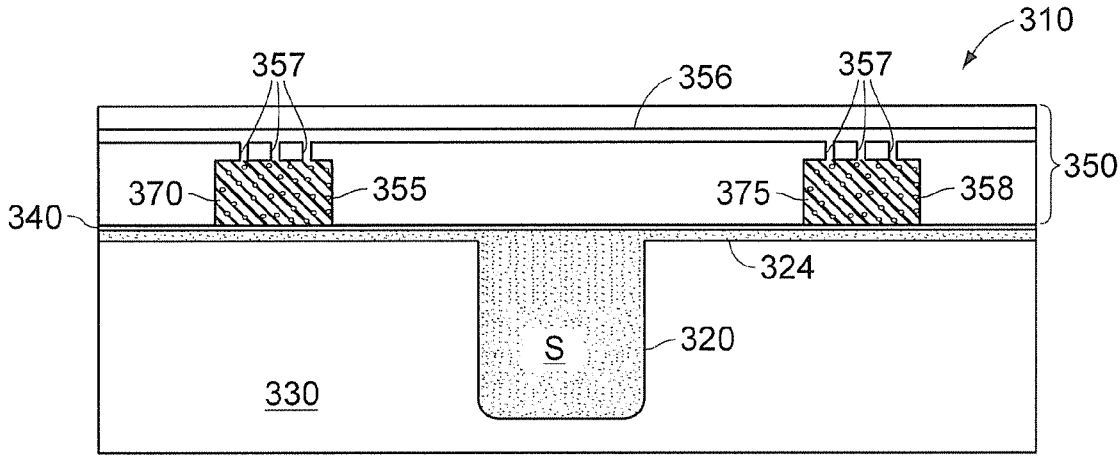
FIGS. 3A-3C illustrate a cross-sectional view of yet another substrate for biological analysis and various steps for sealing the substrate according to an exemplary embodiment of the present teachings.
Figure 3B:
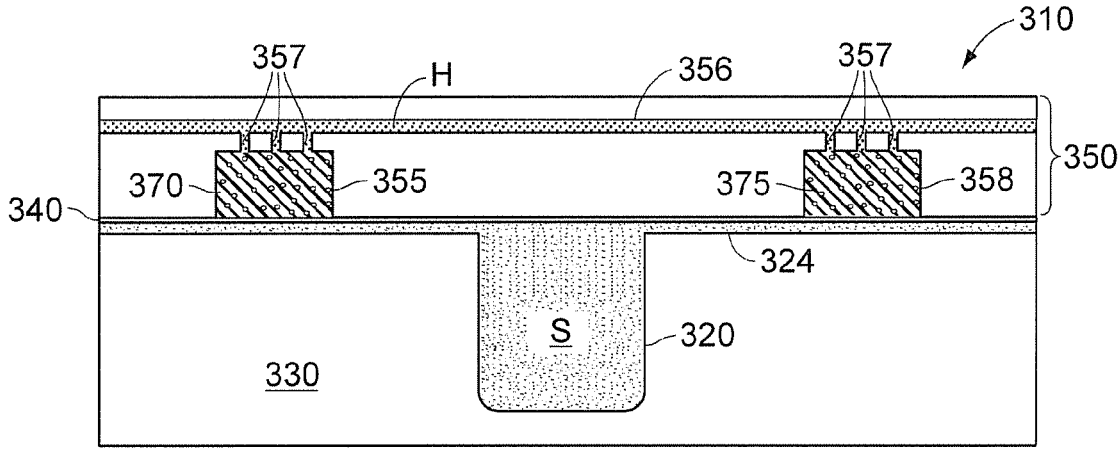
Figure 3C:
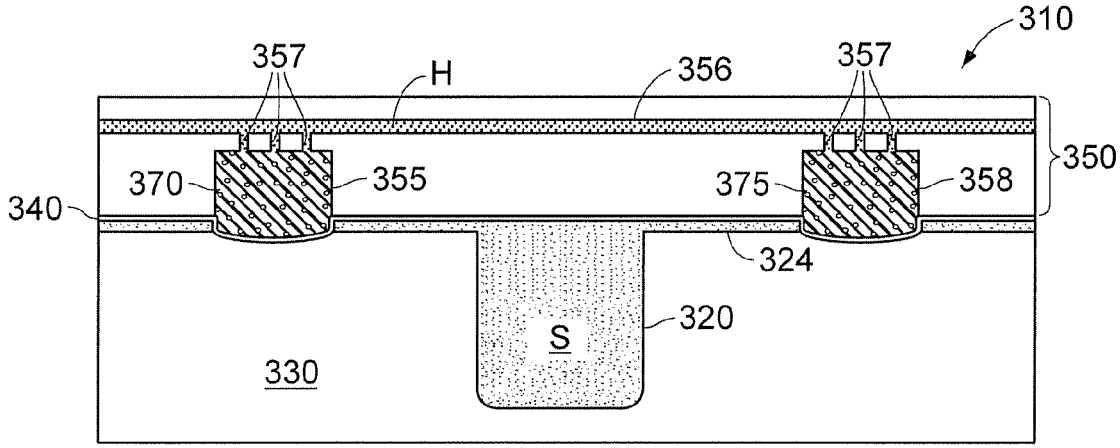

The exemplary embodiments of FIGS. 1A-1C and 2A-2C illustrate a single sample chamber and a single channel in flow communication to distribute sample fluid to the chamber. Those skilled in the art would understand, however, that the chamber also may be in flow communication with a channel configured to receive sample fluid from the chamber, e.g., an outlet channel. Such a configuration is illustrated in the exemplary embodiment of FIGS. 3A-3C. In FIGS. 3A-3C, the base 330 and membrane layer 340 define both an inlet channel 322 and an outlet channel 324 in flow communication with the sample chamber 320. An additional reservoir 358, similar to reservoir 355, may be defined by the additional layer 350 and membrane layer 340 and may be provided in flow communication with the hydration channel 356 via branch channels 357. The reservoir 358 may contain an additional expandable valve mechanism 375 so as to block the outlet channel 322 in a manner similar to that described with reference to the channels 122 and 222 of the embodiments of FIGS. 1A-1C and 2A-2C. Thus, once sample fills the sample chamber 320, the substance H may be supplied through the hydration channel 356 and into the reservoirs 355 and 358 to come into contact with the material forming the valve mechanisms 370 and 375, as shown in FIG. 3B. Upon contact with the substance H, the valve mechanisms 370 and 375 expand and exert a force on the membrane layer 340 such that the membrane layer 340 and the valve mechanisms 370 and 375 enter a portion of the inlet channel 322 and outlet channel 324, respectively, to block those channels and seal the chamber 320. In other words, in the expanded position shown in FIG. 3C, the sample S is substantially prevented from flowing out of the chamber 320 and past the portions of the channels 322 and 324 that are blocked by the valve mechanisms 370 and 375.

Although the exemplary embodiment of FIGS. 3A-3C depicts the reservoirs 370 and 375 in flow communication with the same hydration channel 356, it is envisioned that the reservoirs 370 and 375 could be in flow communication with differing hydration channels. Providing differing hydration channels may permit the valve mechanisms 370 and 375 to be independently actuated (e.g, expanded and/or contracted) as desired, which may be desirable for sequential processing of sample and/or controlling the flow to and from the sample chamber.

As discussed above, in some cases it may be desirable to permit reversible valving (e.g., sealing) of channels of a microfluidic device. For example, such reversible valving may be desired to perform serialized reaction processes within a single microfluidic device used for biological testing and/or to perform sample preparation within such a device. In the case of serialized reaction processes, for example, it may be desirable to sequence a series of chemical reactions and/or processes within a single substrate without exposing the reaction chemistries (e.g., biological sample, reagents, and other reaction-supporting substances) supplied to the substrate to the environment once they have been introduced into the substrate. In the case of sample preparation and/or serialized reaction processes, therefore, it may be desirable to introduce the sample into a first sample chamber or set of sample chambers, and then to seal the first sample chamber or chambers while a reaction occurs and/or the sample mixes with another substance so as to prepare the sample for further processing (e.g., assays), etc. After the desired processing has occurred in the first sample chamber or chambers, it may then be desirable to unseal the chambers and allow the sample to flow out of the sample chambers and to a second sample chamber or group of chambers, another region of the device, and/or a station external to the device for further processing. The description above of the exemplary embodiments of FIGS. 1A-1C, 2A-2C, and 3A-3C discussed reversible valving that is accomplished by contacting the expanded valve mechanisms with a substance used to contract the valve mechanisms so as to unblock the channels and permit fluid flow therethrough. Other exemplary mechanisms for achieving such reversible valving and/or flow control are taught in the exemplary embodiments of FIGS. 4-6, described below.

Figure 4A:
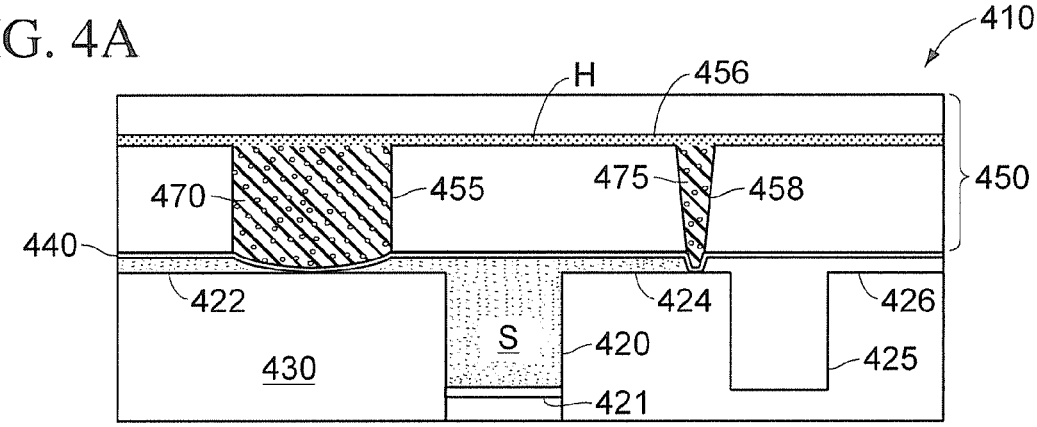
FIGS. 4A-4C illustrate a cross-sectional view of yet another substrate for biological analysis and various steps for sealing and flowing sample through the substrate according to an exemplary embodiment of the present teachings.
Figure 4B:
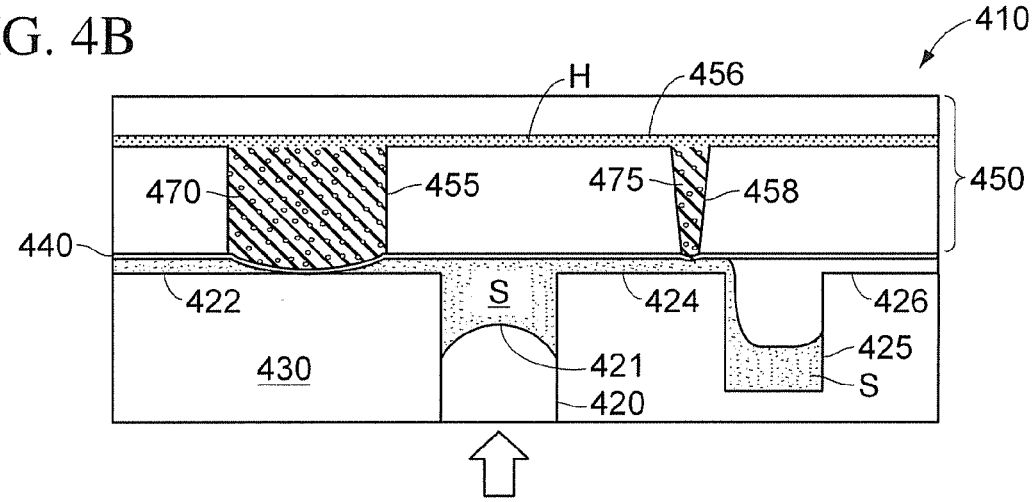
Figure 4C:
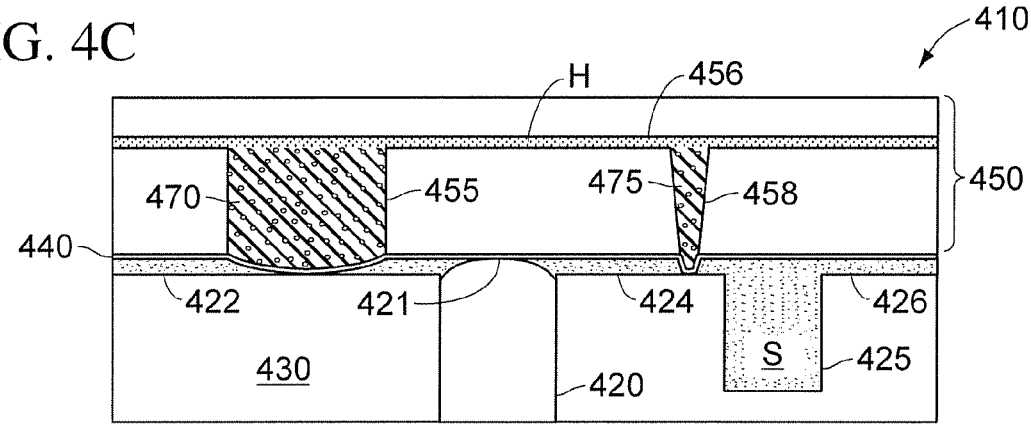

Referring now to FIGS. 4A-4C, an exemplary embodiment of a substrate 410 for biological sample testing that is configured for serialized processing and flow control of sample is illustrated. As shown in FIGS. 4A-4C, the substrate 410 includes a base 430 covered by a membrane layer 440 and together define a first sample chamber 420 and a second sample chamber 425. The base 430 and membrane layer 440 also define a channel 422 and a channel 424 configured to be placed in flow communication with the first sample chamber 420. The channel 422 may be configured to flow sample to the first sample chamber 420 and the channel 424 may be configured to flow sample from the first sample chamber 420. The channel 424 also is in flow communication with the sample chamber 425 and configured to deliver sample from the sample chamber 420 and to the sample chamber 425. An additional channel 426 is configured to be in flow communication with the second sample chamber 425 to deliver sample from the sample chamber 425.

The substrate 410 further includes an additional layer 450 that, together with the membrane layer 440, defines two reservoirs 455 and 458 configured to contain expandable valve mechanisms 470 and 475. The additional layer 450 also defines a channel 457 in flow communication with the reservoirs 455 and 458 to deliver a substance H into contact with the valve mechanisms 470 and 475 to expand the valve mechanisms 470 and 475. In the exemplary embodiment of FIGS. 4A-4C, the reservoirs 455 and 458 are differing in size (e.g., volume) and shape, with the reservoir 455 being larger than the reservoir 458. Each reservoir 455 and 458 may therefore contain differing amounts and configurations of an expandable material, such as an expandable polymer or hydrogel, for example, constituting the valve mechanisms 470 and 475. In the embodiment of FIGS. 4A-4C, the valve mechanism 470 is configured to exert a larger closure force on the membrane layer 440 than is the valve mechanism 475. For example, the larger force exerted by the valve mechanism 470 may be due to a larger area of the valve mechanism 470 acting to close the channel 422, whereas the smaller force exerted by the valve mechanism 475 may be due to a relatively small area of the valve mechanism 475 blocking the portion of the channel 424, as shown schematically in FIGS. 4A-4C.

FIG. 4A illustrates the substrate 410 with the channel 422, the first chamber 420, and a portion of the channel 424 up to valve mechanism 475 being filled with sample S. Filling of the sample S into the substrate 410 can occur via the various mechanisms described above with reference to FIGS. 1-3. The valve mechanisms 470 and 475 are in a closed position in FIG. 4A due to a substance H being supplied via channel 456 into the reservoirs 455 and 458 to expand the valve mechanisms 470 and 475. In the position of FIG. 4A, each valve mechanism 470 and 475 exerts a force on the membrane layer 440, causing the membrane layer 440 and the valve mechanisms 470 and 475 to enter a portion of the channels 422 and 424, respectively, and block the sample S from flowing past the those portions of the channels 422 and 424. Thus, in FIG. 4A, the first sample chamber 420 is isolated (sealed) and the second sample chamber 425 remains empty due to the position of the valve mechanism 475. Processing of the sample S may therefore occur in the first sample chamber 420 while the first sample chamber 420 is sealed and the second sample chamber 425 remains free of the sample S.

Once desired processing of the sample S in the first sample chamber 420 is completed, it may be desirable to flow the sample S from the first sample chamber 420 to the second sample chamber 425, for example, for further processing in the second sample chamber 425. It should be noted that in the case where the sample S is mixed with various products in the first sample chamber 420, the mixture may flow from the first sample 420 chamber to the second sample chamber 425. However, for ease of description, the term sample and label S will be used to refer to the contents flowing through the substrate from one location to the next. To flow the sample S from the first sample chamber 420 to the second sample chamber 425, the first sample chamber 420 may be pressurized via, for example, a mechanical or chemical force. The amount by which the first chamber 420 is pressurized may be sufficient to cause an increase in pressure in the channel 424 so as to cause the membrane layer 440 to deform and move the valve mechanism 475 into a position that permits the sample S to flow through the channel 424 and past the position of the valve mechanism 475, as shown in FIG. 4B. According to various embodiments, the pressurization of the first sample chamber 420 may not be sufficient to move the valve mechanism 470 from the closed position blocking the portion of the channel 422.

As shown in the exemplary embodiment of FIGS. 4A-4C, the first sample chamber 420 may extend through the thickness of the base 430 and be provided with a movable (e.g., deformable) bottom wall 421. According to various exemplary embodiments, the bottom wall 421 may be made of a membrane material and a force may be supplied in the direction of the arrow indicated in FIG. 4B on the bottom wall 421. By way of example only, a small burst pack (not shown) containing a low pH fluid, such as, for example, acetic acid, and a carbonate material that, when mixed with each other, form a volume of $CO_2$ may be provided within the chamber 420 between the wall 421 and the end of the base 430.

The volume of $CO_2$ may expand, causing the bottom wall 421 to move upwardly, either via deformation or via movement relative to the sample chamber 420, depending on the structure of the bottom wall 421. The bottom wall 421 may separate the contents of the burst pack from the remaining contents of the sample chamber 420. This upward movement of the bottom wall 421 in turn causes the sample S to become pressurized and, due to the relatively small closure force of the valve mechanism 475, causes the valve mechanism 475 to move out of the closed position to permit the sample S to flow from the first sample chamber 420 past the valve mechanism 475 and into the second sample chamber 425, as shown in FIG. 4B. Other mechanisms for providing the force on the bottom wall 421 also are envisioned and considered within the scope of the present teachings. Such mechanisms may include, but are not limited to, for example, providing a mechanical force, such as a spring (e.g., a shape memory spring) or the like that may be triggered upon an actuator or heat to act on the bottom wall 421, providing an opening in the bottom of the base 430 and applying a direct force on the deformable wall 421.

Once a desired amount of sample S has moved from the sample chamber 420 (e.g., the sample chamber 420 has been substantially emptied) to the sample chamber 425 and the channel 422 no longer experiences an increased pressure, the valve mechanism 475 may return to the closed position, as depicted in FIG. 4C. Further processing of the sample S may then occur in the sample chamber 425, if desired. Isolation of the sample chamber 425 also may occur via the valve mechanism 475 being in the closed position and any other valve mechanisms (not shown) being in a position to block flow through the channel 426.

The exemplary embodiment of FIGS. 4A-4C thus shows how differential sealing and/or valving may occur by providing valve mechanisms having differing closure forces and by altering a pressure in the channels associated with the valve mechanisms.

Figure 5:
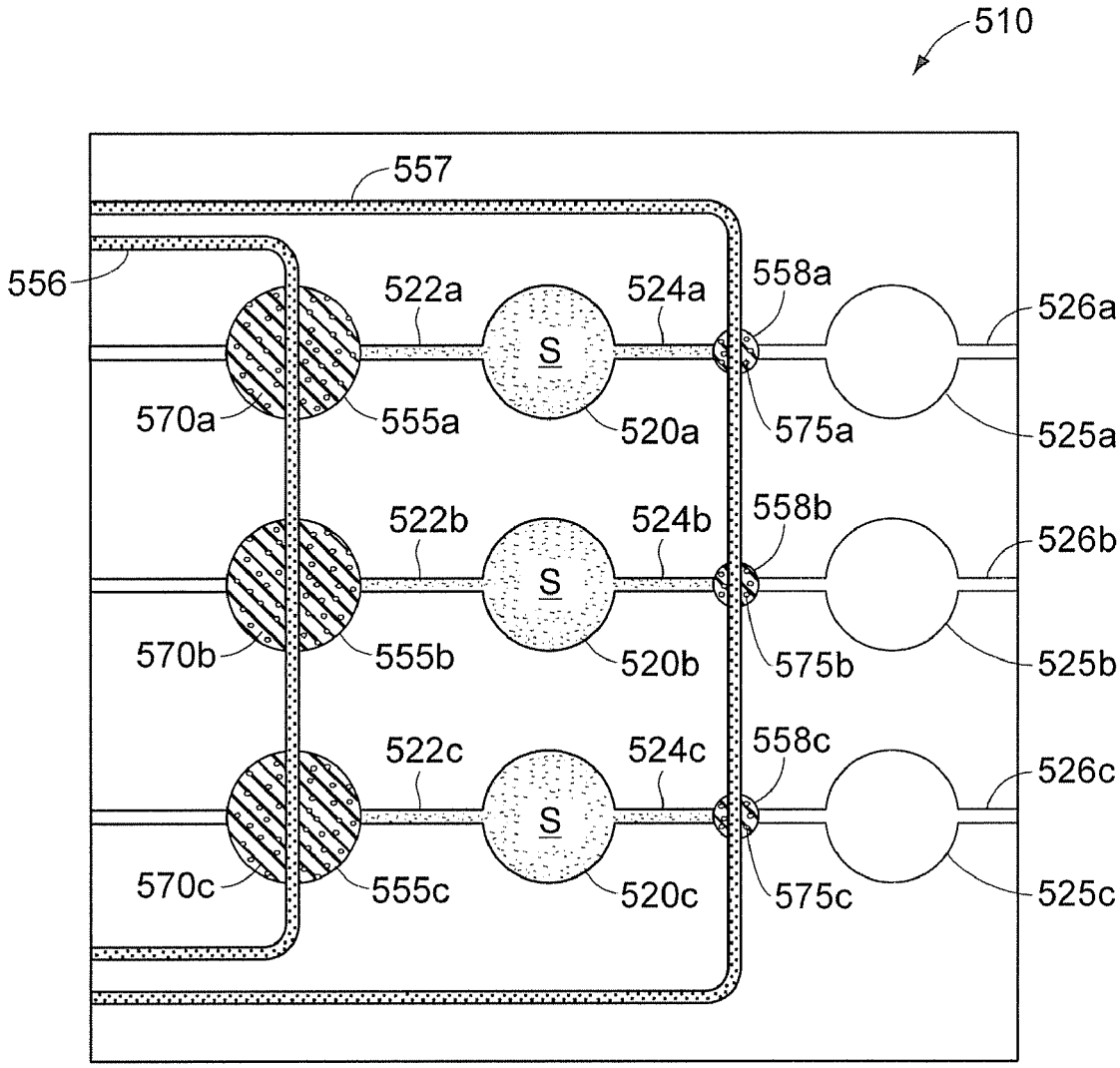
FIG. 5 illustrates a top view of a substrate for biological analysis according to another exemplary embodiment of the present teachings.

FIG. 5 illustrates a plan view of another exemplary embodiment of a substrate 510 that defines a plurality of parallel groups of sample chambers. Each group of sample chambers in FIG. 5 includes a first sample chamber 520 and a second sample chamber 525 connected in series in a manner similar to the sample chambers 420 and 425 of the embodiment of FIGS. 4A-4C. Three groups of sample chambers are depicted in FIG. 5 and denoted by the subscripts a, b, and c. The three groups shown in FIG. 5 are supplied with sample S in parallel. The first sample chambers 520*a*, 520*b*, and 520*c* in each group thus are in flow communication with three separate channels 522*a*, 522*b*, and 522*c* to flow sample to the sample chambers 520*a*, 520*b*, and 520*c*, respectively, and with three separate channels 524*a*, 524*b*, and 524*c* to flow sample from the sample chambers 520*a*, 520*b*, and 520*c*, respectively. The three channels 524*a*, 524*b*, and 524*c* also are in flow communication with the second sample chambers 525*a*, 525*b*, and 525*c*, respectively, to flow sample from each of the first sample chambers 520*a*, 520*b*, and 520*c*, respectively, into each of the sample chambers 525*a*, 525*b*, and 525*c*, respectively. Further, the three sample chambers 525*a*, 525*b*, and 525*c* are in respective flow communication with separate channels 526*a*, 526*b*, and 526*c* configured to flow sample from the chambers 525*a*, 525*b*, and 525*c*.

Similar to the embodiment of FIGS. 4A-4C, each group of chambers of the substrate 510 of FIG. 5 includes upstream expandable valve mechanisms 570*a*, 570*b*, and 570*c* associated with each channel 522*a*, 522*b*, and 522*c*, and downstream expandable valve mechanisms 575*a*, 575*b*, and 575*c* associated with each channel 524*a*, 524*b*, and 524*c*. Also similar to the embodiment of FIGS. 4A-4C, and as depicted in FIG. 5, the upstream valve mechanisms 570*a*, 570*b*, and 570*c* may exert a larger closer force (e.g., have a larger area blocking the channels 522*a*, 522*b*, and 522*c*) than the downstream valve mechanisms 575*a*, 575*b*, and 575*c*. In contrast to the embodiment of FIGS. 4A-4C, however, the substrate 510 may have an additional layer that defines two hydration channels 556 and 559. The first channel 556 may be configured to be in flow communication with the reservoirs 555*a*, 555*b*, and 555*c* containing the upstream valve mechanisms 570*a*, 570*b*, and 570*c* to flow a substance into contact with the valve mechanisms 570*a*, 570*b*, and 570*c*. The second channel 557 may be configured to be in flow communication with the reservoirs 558*a*, 558*b*, and 558*c* containing the downstream valve mechanisms 575*a*, 575*b*, and 575*c* to flow a substance into contact with the valve mechanisms 575*a*, 575*b*, and 575*c*. Thus, the upstream valve mechanisms 570*a*, 570*b*, and 570*c*, may be actuated independently (e.g., moved to the position to block the channels 522*a*, 522*b*, and 522*c*, respectively) of the downstream valve mechanism 575*a*, 575*b*, 575*c*.

Although not shown in the view of FIG. 5, the first sample chambers 520*a*, 520*b*, and 520*c* may be configured in a manner similar to the first sample chamber 420 in FIGS. 4A-4C such that the chambers 520*a*, 520*b*, and 520*c* could be pressurized to open the downstream valve mechanisms 575*a*, 575*b*, and 575*c* and permit sample to flow from the sample chambers 520*a*, 520*b*, and 520*c* into the sample chambers 525*a*, 525*b*, and 525*c*, as desired and described above with reference to FIGS. 4A-4C.

Those skilled in the art would recognize that any number of sample chambers may be connected in series for each group and that any number of valve mechanisms may be associated with the various channels connecting the series of chambers and configured to supply sample thereto. In turn, more than two separate hydration channels may be provided. For example, the number of hydration channels may correspond to the number of valve mechanisms provided per group of sample chambers, with each channel in flow communication with valve mechanisms in the same relative position of each group. Moreover, more than one sample chamber in each group may be configured to be pressurized so as to permit downstream valve mechanisms associated with the sample chambers to move to a position to permit sample to flow past the valve mechanisms. According to various embodiments, the valve mechanisms and chambers in a group connected in series may be appropriately sized, configured, and pressurized such that pressurization of a particular chamber in the series is sufficient to open only the downstream valve mechanism associated with that chamber, while not affecting the upstream valve mechanism. Of course, those skilled in the art would understand numerous arrangements and configurations for the sample chambers and valve mechanisms in accordance with the teachings herein in order to achieve a desired control over the flow through the substrate.

In yet other embodiments, a substance configured to contract the valve mechanisms so as to place the valve mechanisms in a position external to the channel so as to not block sample flow past the valve mechanisms may be supplied to the respective hydration channels. Thus, for example, if it is desired to open the downstream valve mechanisms 575*a*, 575*b*, and 575*c* in FIG. 5 while maintaining the upstream valve mechanisms 570*a*, 570*b*, and 570*c* in a closed position, a substance (such as, for example, a solvent) configured to contract the valve mechanisms 575*a*, 575*b*, and 575*c* may be supplied via the channel 557. Contracting the valve mechanisms 575*a*, 575*b*, and 575*c* may permit sample to move from the sample chambers 520*a*, 520*b*, and 520*c* and into the chambers 525*a*, 525*b*, and 525*c*. The flow of the sample from the chambers 520*a*, 520*b*, and 520*c* may be accomplished via a variety of filling techniques, such as, for example, a vacuum force exerted to pull the sample and/or pressurization of the sample in the sample chambers 520*a*, 520*b*, and 520*c*, as described above. Moreover, separate hydration channels may be provided in flow communication with each group of valve mechanisms 570*a*-570*c* and 575*a*-575*c*. For example, a first hydration channel may be configured to flow a substance configured to expand the valve mechanisms 570*a*-570*c* and 575*a*-575*c*, while a second hydration channel may be configured to flow a substance configured to contract the valve mechanisms 570*a*-570*c* and 575*a*-575*c*.

Yet another embodiment of a substrate configured for serialized reactions and/or sample preparation via reversible valving and/or flow control is depicted in FIGS. 6A-6E. For purposes of simplification of the drawings, FIGS. 6A-6E do not each depict all of the various components of the substrate 610 and the shading of the various valve mechanisms and transfer valve mechanisms has been removed. However, the structure is similar to the other substrate embodiments described herein, and includes a base 630, a membrane layer 640 and an additional layer 650. The embodiment of FIGS. 6A-6E operates similarly to that of FIGS. 4A-4C, including a plurality of sample chambers 620, 625, and 630 connected in series via a plurality of channels 622, 624, 626, and 628. Each channel 622, 624, 626, and 628 is associated with a valve mechanism 670, 675, 680, and 685 that may be formed of an expandable material contained in a reservoir 655, 658, 665, and 668 formed in the substrate, as has been described with reference to the various embodiments above. Further, a hydration channel 656 may be formed in the additional layer 650 of the substrate and in flow communication with each of the reservoirs 655, 658, 665, and 668, for example, via branch channels 667. It should be noted that not all of the branch channels leading from the hydration channel 656 are shown in each of FIGS. 6A-6E in order to highlight the valve mechanisms being activated in each figure. Further, with the exception of the valve mechanism 670, all of the valve mechanisms appear to be the same size. The valve mechanisms and/or the reservoirs containing them, however, may be the same or different in size, shape, material, physio-chemical properties, etc. depending on, for example, the desired flow control over the sample through the substrate and/or closure force of each valve mechanism. Similarly, the substance used to expand and/or contract the valve mechanisms may differ. Those skilled in the art would understand how the valve mechanisms, reservoirs, and/or substance for contracting and/or expanding the valve mechanisms to achieve a desired control over flow through the substrate based on the present teachings.

In contrast to the embodiment of FIGS. 4A-4C, the embodiment of FIGS. 6A-6E utilizes transfer valve mechanisms 690, 695, and 700 associated with each of the chambers 620, 625, and 635 to pressurize the chambers 620, 625, and 635 to flow sample from the chambers 620, 625, and 635, as will be described in further detail below. Like the valve mechanisms 670, 675, 680, and 685, the valve mechanisms 690, 695, and 700 may be formed of an expandable material, such as, for example, an expandable polymer, for example, polyacrylamide, or a hydrogel, contained in reservoirs 693, 696, and 703, respectively, defined by the additional layer 650 and membrane layer 640 of the substrate 610. When it is desired to flow sample from a chamber 620, 625, or 635, a substance configured to expand the valve mechanisms 690, 695, or 700 may be introduced into the corresponding reservoir 693, 696, or 703 via the channel 656 and branch channels 659. Upon expansion, the valve mechanisms 690, 695, and 700 exert a force on the membrane layer 640 and the valve mechanisms 690, 695, and 700 and the membrane layer 640 enter the chambers 620, 625, and 635, respectively, thereby pressurizing the chambers 620, 625, and 635 and causing sample in the chambers 620, 625, and 635 to be displaced. In various embodiments, pressurization of a sample chamber 620, 625, or 635 may in turn pressurize the channels 624, 626, or 628, respectively, and cause the corresponding valve mechanism 675, 680, or 685 to move to a position substantially external to the corresponding channel 624, 626, or 628 so as to permit the sample to flow past the valve mechanism 675, 680, or 685.

Exemplary steps of flowing sample from one chamber to the next and isolating the same using the valve mechanisms and transfer valve mechanisms of the embodiment of FIGS. 6A-6E will now be described.

Figure 6A:
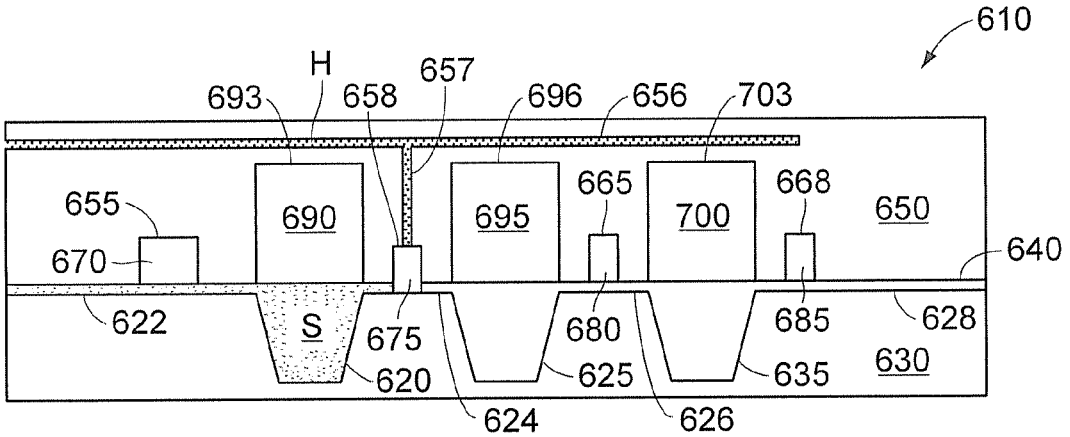
FIGS. 6A-6E illustrate a cross-sectional view of another substrate for biological analysis and various steps for sealing and flowing sample through the substrate according to an exemplary embodiment of the present teachings.
Figure 6B:
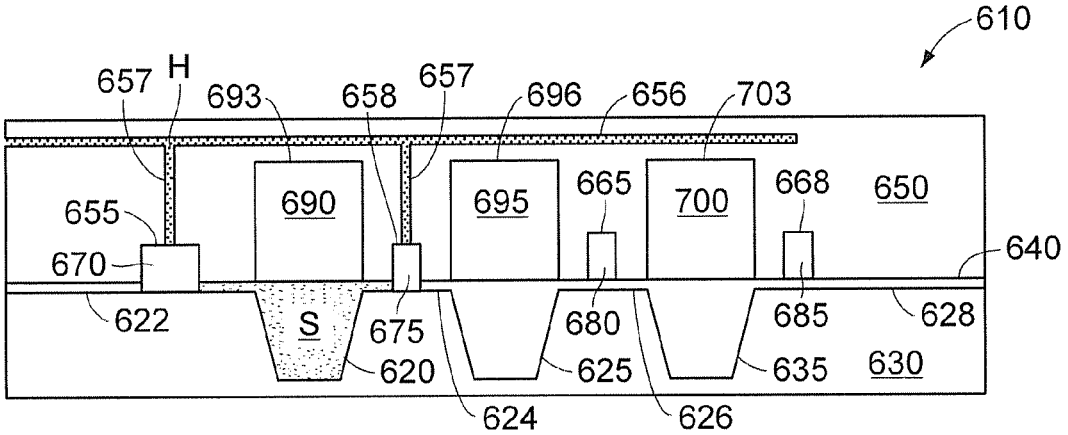

In FIG. 6A, a biological sample S may be introduced to the substrate 610 via any of the filling techniques in accordance with the present teachings, such as, for example, via use of a positive pressure filling mechanism. Upon introduction of the sample S into the channel 622, the valve mechanism 670 is in an open position (e.g., a nonexpanded configuration) and is substantially external to the channel 622 so as to permit sample to flow through the channel 622 past the valve mechanism 670 and into the sample chamber 620. In FIG. 6A, the transfer valve mechanism 690 also is in an open, nonexpanded position such that the sample S can fill the sample chamber 620. The valve mechanism 675 downstream of the sample chamber 620 may be expanded by introducing a substance H, such as water or a solvent, for example, into the channel 656 and the channel 657 in flow communication with the reservoir 658 containing the valve mechanism 675. Thus, during filling of the sample chamber 620, the sample S may be blocked from flowing past the valve mechanism 675 in the channel 624, as illustrated in FIG. 6A.

After the first sample chamber 620 has been filled with sample S, the valve mechanism 670 upstream of the sample chamber 620 may be actuated by introducing a substance H for expanding the valve mechanism 670 into the reservoir 655 via the channel 656 and the branch channel 657 leading to the reservoir 655. Thus, in the exemplary step of FIG. 6B, the sample chamber 620 may be filled with sample S and isolated by actuating (e.g., expanding) valve mechanisms 670 and 675 so as to block the portions of the channels 622 and 624 at the locations of the valve mechanisms 670 and 675. A desired processing of the sample S in the sample chamber 620 may occur in the configuration of the substrate in FIG. 6B.

Figure 6C:
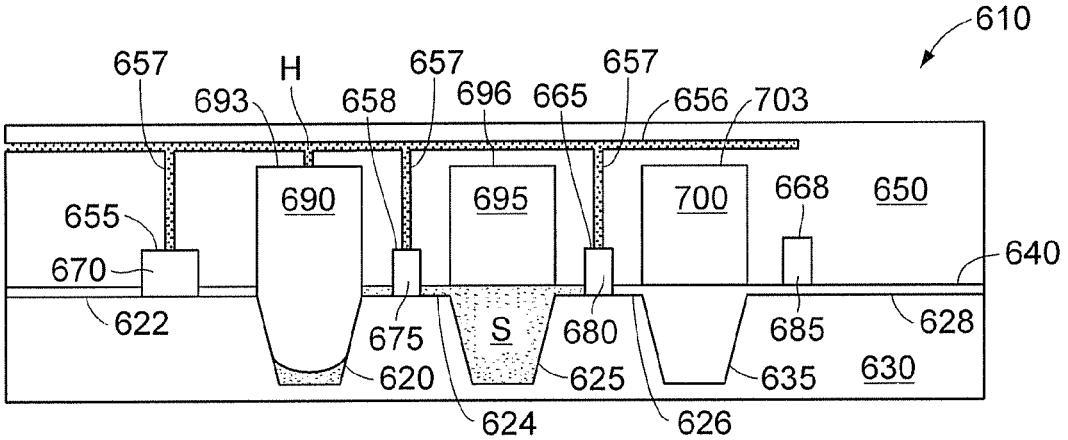

Upon completion of the processing step of the sample S in the sample chamber 620, the sample S may be moved from the sample chamber 620 and into the next sample chamber 625. To move the sample S from the sample chamber 620, the transfer valve mechanism 690 may be actuated, for example, by expanding the valve mechanism 690 by introducing the substance H via channel 656 and the branch channel 659 in flow communication with the reservoir 693 containing the valve mechanism 690. Expanding the valve mechanism 690, as shown in FIG. 6C, may cause the valve mechanism 690 to deform the membrane layer 640, causing the membrane layer 640 and the valve mechanism 690 to enter the sample chamber 620 and displace the sample S therefrom. Displacement of the sample S from the sample chamber 620 may in turn increase the pressure in the channel 624 sufficiently to deform the membrane layer 640 over the channel 624 and move the valve mechanism 675 into an open position in a manner similar to that described above for valve mechanisms 475 of the exemplary embodiment of FIGS. 4A-4C.

To fill the sample chamber 625, the valve mechanism 680 may be positioned so as to block the channel 626 downstream of the sample chamber 625 so that the sample S cannot flow past the valve mechanism 680. The valve mechanism 680 may be expanded to block the channel 626 by introducing the substance H via the channel 656 and the branch channel 657 in flow communication with the reservoir 665 containing the valve mechanism 680.

With the transfer valve mechanism 690 in the expanded position within the sample chamber 620, the valve mechanism 675 in the open position (not shown), and the valve mechanism 680 in the closed position, the sample S may be moved from the sample chamber 620 and into the sample chamber 625. After the sample chamber 625 has been filled with a desired amount of sample S and the pressure in the channel 624 has equalized, the valve mechanism 675 may return to its closed position blocking the channel 624, as depicted in FIG. 6C. In the configuration of FIG. 6C, the sample chamber 625 is isolated and a desired processing of the sample S in the sample chamber 625 may be performed.

Figure 6D:
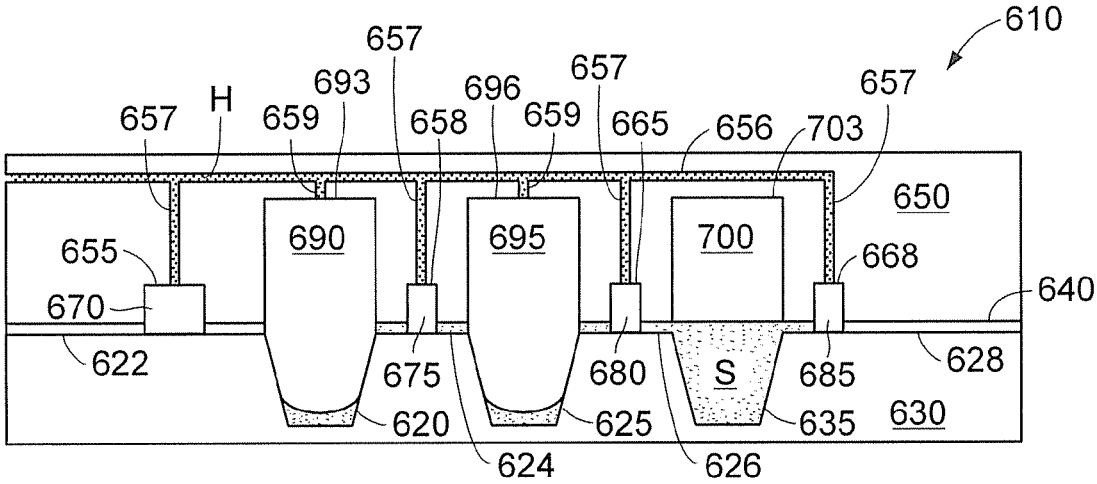
Figure 6E:
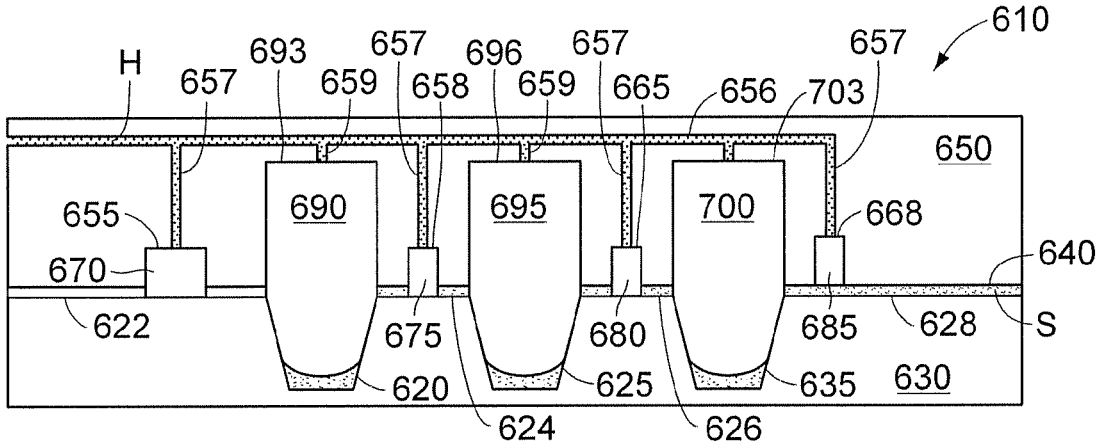

Referring now to FIG. 6D, the same procedure as described above may be repeated with the transfer valve mechanism 695 and valve mechanisms 680 and 685 to move the sample S from the sample chamber 625 to the sample chamber 700 in order to perform further processing of the sample chamber S in the sample chamber 635. Finally, in FIG. 6E, after the desired processing in the sample chamber 635 has been completed, the transfer valve mechanism 700 may be actuated to displace the sample S from the sample chamber 635 into the channel 628 and, for example, out of the substrate 610.

Although not shown in the exemplary embodiment of FIGS. 6A-6E, it should be understood that various flow control devices, such as, for example, valves, may be used to selectively flow the substance H supplied to the channels 656, 657, and 659 to the reservoirs 655, 658, 665, 668, 693, 696, and 703 in order to actuate (e.g., expand) the valve mechanisms 670, 675, 680, 685, 690, 696, and 700, as desired. Also, in FIGS. 6A-6E, the shape and size of the valve mechanisms and reservoirs are not necessarily to scale and those skilled in the art would understand that the shapes and sizes may be selected as desired to achieve a desired operation of the device.

Moreover, in accordance with the present teachings, in lieu of or in addition to using pressurization of the channels 624, 626, and 628 to move the valve mechanisms 675, 680, and 685 into a position wherein the sample can flow past the valve mechanisms 675, 680, and 685, it may be possible to introduce a substance configured to contract the valve mechanisms 675, 680, and 685 into the channel 656 and corresponding branch channels 657, in accordance with the present teachings. To reactuate the valve mechanisms 675, 680, and 685 (e.g., to expand the valve mechanisms to block the channels 624, 626, and 628), the substance H configured to expand the valve mechanisms may be reintroduced into the corresponding reservoirs 658, 665, and 668 via the channel 656 and branch channels 657. Alternatively, differing sets of hydration and branch channels may be provided in flow communication with the reservoirs 658, 665, and 668, with one set being used to deliver the substance for expanding the valve mechanisms and the other set being used to deliver the substance for contracting the valve mechanisms. Similarly, contraction of any of the valve mechanisms 670, 690, 695 or 700 may occur by introducing a substance configured to contract those valve mechanisms into the respective reservoirs 655, 693, 696, or 703 either via channels 656, 657, and 659 or via separate channels.

Also, although the exemplary embodiment of FIGS. 6A-6E depicts valve mechanisms that operate from the top of the chambers and channels in the figures, it should be understood that one or more of the various valve mechanisms may operate from the bottom of the chambers and/or channels shown in the figures. In one exemplary embodiment of a bottom-up design, the valve mechanism in its contracted state may occupy a portion of and/or define a bottom portion of, for example, a sample chamber (e.g., 620, 625, or 635) and a suitable membrane layer may be provided so as to isolate the chemistry (e.g., biological sample) contained in the sample chamber from the valve material. Suitably arranged hydration channels and/or branch channels may be used to deliver a substance into contact with the valve mechanism to cause the valve mechanism to expand and occupy additional space within the sample chamber by pressing on the membrane layer. This in turn may displace any contents (e.g., sample) in the sample chamber in a manner similar to that described above.

In using the transfer valve mechanism embodiments described herein, the design of the valve mechanisms may be selected so as to provide controlled metering structures. In other words, the amount of sample displaced from a sample chamber upon activation of a transfer valve mechanism may be controlled based on the configuration of the valve mechanism, including, for example, the degree of expansion of the valve mechanism.

It also should be understood that the substrate 610 may be modified to include any number of sample chambers connected in series and/or to include groups of sample chambers provided in parallel, for example, as described with reference to the embodiment of FIG. 5. All of the substrate embodiments described herein may be modified to connect sample chambers and control the flow of the sample throughout the substrate in a variety of ways. The exemplary embodiments shown and described herein are intended to illustrate relatively simplified configurations for highlighting the principles of operation of the valve mechanisms and skilled artisans would understand how to modify the substrate configurations based on the present teachings in order to achieve desired flow and/or sample processing. It should therefore be understood that the valve mechanisms described above in conjunction with exemplary embodiments may be used with microfluidic devices having various configurations and including an array of sample chambers in flow communication with a fluid distribution network of inlet channels, outlet channels, and main supply fluid channels, such as, for example, the microfluidic device having the fluid distribution network depicted in FIG. 7. Those skilled in the art would understand a variety of microfluidic device configurations with which the valve mechanisms in accordance with the present teachings could be implemented to perform isolation of sample chambers and/or to control the fluid flow through various chambers, channels, and other sample containment portions of the device.

It will be appreciated that embodiments described herein and for the purpose of describing and illustrating various structures below, water expandable materials/matrices including for example hydrogels and polyacrylamide may be used. It will be further understood that the aforementioned microfluidic structures are not limited to water expandable materials alone and that other fluid expandable/swellable materials may be used. For example, polymers that swell in response to alcohols or other fluids may be used to create the swellable valves described herein and thus the fluid used to "activate" the expandable material need not necessarily include water or be water-based. For purposes of simplification and illustration for the description of microfluidic structures, "water" is used to describe the fluid that causes the "polyacrylamide" to expand. The "water" or hydrating solution my also be either a high or low pH solution or in some instances a dehydrating solution such as an alcohol.

A variety of shapes can be formed based upon the present teachings. Inclusion of a membrane, both deformable and or preformed may be used to isolate the "polyacrylamide"/swellable gel from the chemistry or area of interest. Deformable membrane materials suitable for use include by way of example elastomers that are compatible with the chemistries/materials in use. Examples of possible elastomers include polydimethylsiloxanes (PDMS) and/or polyurethanes among other compounds. Examples of preformed membrane materials may include polypropylene and/or polypropylene which may be used in embodiments where the expanded shape of membrane is molded into the film material before assembly.

Categories of structures of interest may include free space and surface constrained structures as well as displacements. Displacements have overlap with the broad categories of free space and surface constrained structures and may differ in that these structures are capable of moving or transferring volumes of material from one point to another rather than isolate and/or partition the fluid or chemistry of interest. It will be appreciated that various microfluidic structures may incorporate and utilize any or all of these structures and/or functions.

An additional aspect of the present teachings is that they may involve the inclusion of a cross linking agent into the swellable matrix (e.g. polyacrylamide) where the application of a stimulus triggers a alteration in the physical properties of the swellable matrix. For example. Heat may be used as a stimulus trigger and subsequent to the expansion of the swellable matrix/polyacrylamide an appropriate amount may "fix" or solidify the swellable matrix/polyacrylamide into a more rigid/solid form. Fixing of the swellable matrix may be desirable to create an at least partially secure/semi-permanent/non-reversible structure that is resistant to dehydration or decreases in volume.

In various embodiments, exemplary characteristics of free space structures may include the shared characteristic where two or more polyacrylamide/membrane surfaces expand against each other to close off/constrict a microfluidic channel or isolate the chemistry/area of interest. For example, polyacrylamide may polymerized upon and dried down on the outside surface of a cylindrical or flattened tubular membrane structure as depicted in FIG. 7. The flexible cylindrical or tubular membrane may be first filled with chemistry/material of interest followed by hydration of the polyacrylamide. Upon hydration, the polyacrylamide expands and closes off/constricts the cylindrical/tubular membrane. Such a structure may take the form of "rings" or bands of polyacrylamide along the length of the membrane cylinder/tube or the form of a continuous surface. In the ring form, the contents of the tube may become partitioned. In the latter form the contents of the tube would be moved along the length of the tube. The rate and manner in which the polyacrylamide is hydrated controls the rate and manner that the chemistry in the tube is isolated or transported. Thus a deformable tubular membrane as shown in FIG. 7 may have polyacrylamide polymerized to the surface in predefined locations. As shown in the illustration, the polyacrylamide may be formed into either isolated bands or longer surfaces. When the polyacrylamide is hydrated the bands swell into "free space" and collapse/constrict the portions of the tubular membrane upon which they were initially formed. In various embodiments, exemplary characteristics of surface constrained structures may take advantage of an opposing rigid/semi-rigid surface or surfaces to expand against to effect closure or isolation of a microfluidic structure as exemplified previously. It is contemplated that in some embodiments the rigid surface may be planar and contain pockets and/or wells or that there may be a multiple of planar surfaces working in coordination. The constraining surface may also take the form of a curved surface.

Surface constrained structures may have the water delivered to the swellable matrix/polyacrylamide by way of channel or micro channel structures. The connection between the water delivery channels and the volume containing the polyacrylamide (e.g. valve pocket) may be by way of a "shower head" array of through-holes. The design of the through holes may plays a role in the function of the valving structure. The through holes (typically a plurality of through holes) may be configured to deliver the fluid/water to the swellable matrix/polyacrylamide without requiring significant pressurization of the fluid/water. Thus the fluid may be delivered by forces used to achieve the initial filling of the water delivery micro channels including capillary action. The array of through holes may further be configured to preserve sufficient surface area such that when the matrix/polyacrylamide swells there is sufficient surface area/tension to contain and constrain the expansion. Through holes that are too large in diameter relative to the surface of the valve chamber or through holes that are too small may be avoided in this manner.

In various embodiments, the cross-link density of the swellable matrix/polyacrylamide plays a role in the function of the valve and the surface area of the through holes. A highly cross-linked polymer may be configured to not swell as much as a polymer that has less cross-linking. A polymer that is highly cross-linked may also not need as much surface area to press against to function properly. A polymer that is less cross-linked may be configured to have much more surface area to press against. A low level of cross linking allows the polymer to swell to a much higher degree but it will also allow the polymer to extrude through the through-holes in the shower head structure resulting in less force being applied to the membrane for the purpose of closing off a channel. It is anticipated that a range of cross-link densities and consequently a range of showerhead designs will be fabricated depending on the particular application. One of skill in the art will recognize these design elements and how they may be used in the design of microfluidic structures. One of skill in the art will further recognize that the size of the structures that can be fabricated is not necessarily limited or constrained. For example volumes on the order of a picoliter may be used as well as large volumes of several liters or more can be readily contemplated and adapted for use with the present teachings.

Figure 8:
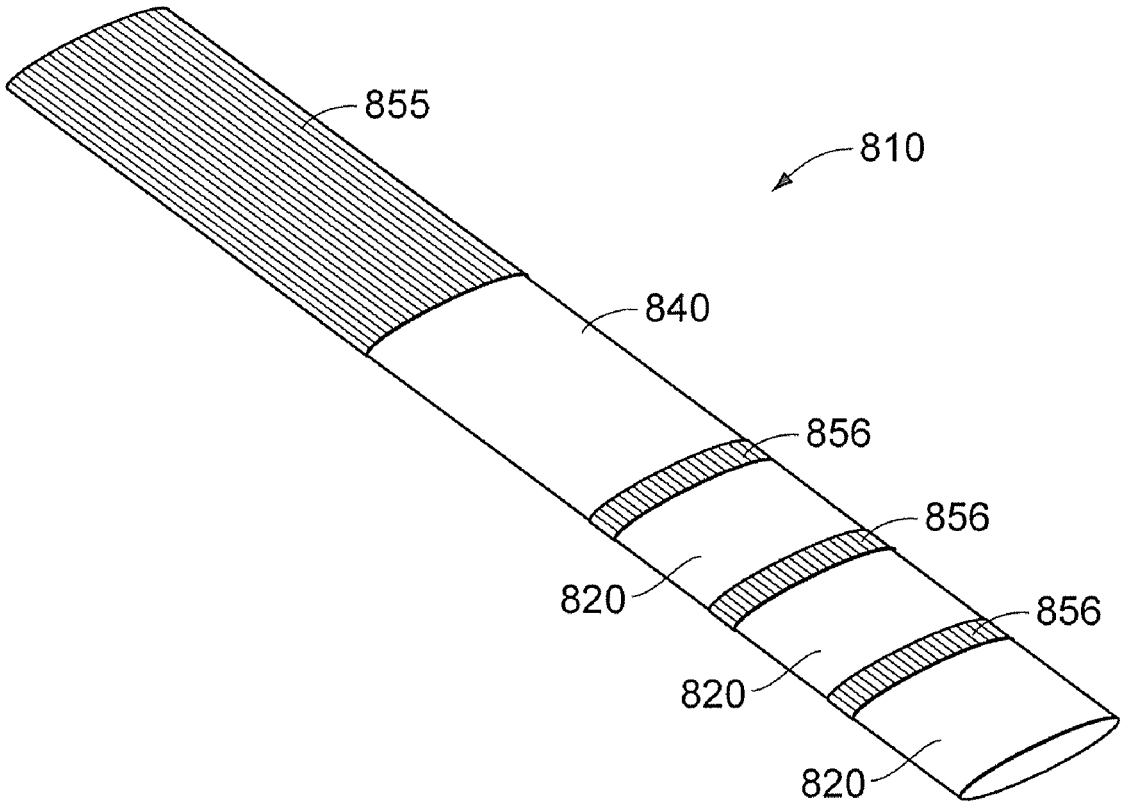
FIG. 8 illustrates a perspective view of a device for biological sample testing according to another exemplary embodiment of the present teachings.

In various embodiments, characteristics of displacement structures take advantage of the swelling polyacrylamide to fill a volume occupied by a chemistry/material of interest thereby displacing it and causing it to move to another predetermined location in the microfluidic device. In one aspect, a a "top down" form of displacement may be devised as illustrated elsewhere. Another design may include a "bottom up" According to other exemplary embodiments, a microfluidic device may include more than one membrane surface portion that defines a fluid containment and/or fluid flow structure and an expandable valve mechanism may be configured and arranged relative to the membrane surface portions so as to cause the membrane surface portions to come into contact with each other and substantially prevent fluid flow in the structure at the point of closure. FIG. 8 schematically depicts an exemplary embodiment of such a microfluidic device.

In FIG. 8, a microfluidic device 810 may include a deformable membrane layer 840 configured so as to form a tubular structure, such as, for example, a flattened tubular structure as shown or a cylindrical tubular structure (not shown). One or more expandable valve mechanisms 855 and/or 856 may be provided along an outer surface of the tubular membrane 840 at one or more positions along the length of the tube. For purposes of illustration, FIG. 8 depicts a plurality of such valve mechanisms 855 and 856, which will be described in further detail below. By way of example only, the expandable valve mechanisms may be in the form of polyacrylamide that is polymerized upon and dried onto the outer surface of tubular membrane 840. However, based on the teachings herein, those having skill in the art would recognize other materials and/or techniques for depositing those materials to form the valve mechanisms on the outer surface of the tubular membrane 840.

In use, the tubular membrane 840 may be filled with chemistry (e.g., a biological sample) and one or more of the valve mechanisms 855 and 856 may be expanded. For example, the one or more valve mechanisms 855 and 856 may be expanded via hydration of the material forming the valve mechanisms, as has been described herein. Upon hydration and expansion, the one or more valve mechanisms 855 and 856 may exert a force on the outer surface of the tubular membrane 840 directed substantially toward a center of the tube. The deformable nature of the membrane 840 in turn may cause inner surface portions of the membrane 840 to come into contact with each other, thereby substantially closing of the lumen defined by the tubular membrane 840 and preventing sample from flowing past those contacting portions.

As depicted in FIG. 8, according to exemplary aspects, the valve mechanisms may take the form of a ring (e.g., band-like) structure around the tubular membrane 840, as denoted by reference elements 856, or may take the form of a continuous surface covering a larger area around the tubular membrane 840, as denoted by reference element 855. In the case of the valve mechanisms 856 having the ring form, the contents (e.g., biological sample) of the tubular membrane 840 may become partitioned and isolated, for example, into separate chamber like structures 820 defined between expanded the valve mechanisms 856. In the case of the valve mechanism 855 having a continuous form, the contents (e.g., biological sample) of the tubular membrane 840 may be moved along the length of the tube away from the expanded valve mechanism 856. The rate and manner in which the various valve mechanisms are expanded (e.g., hydrated) may control the rate and manner that the contents in the tubular membrane 840 is isolated and/or transported A variety of mechanisms may be used to hydrate the valve mechanisms in the embodiment of FIG. 8. By way of example only, the tubular membrane 840 may be encased in an outer structure. In the bottom up design the dry/unswelled form of the swellable matrix/polyacrylamide may occupy or form the well. The deformable membrane may be incorporated into the design and isolate the polyacrylamide from the chemistry of interest. Upon, for example, a cylindrical structure or the like, that contains a network of hydration the polyacrylamide may swell to displace the chemistry. The manner is which the fluid/water is delivered to the swellable matrix/polyacrylamide may influence use of design over the another other depending on the desired intent/operation of the microfluidic structure. It will be appreciated that displacement designs can be anticipated to that form metering structures where the volume of chemistry transferred is controlled by the displacement of a know volume channels configured to flow a hydrating substance into contact with the one or more valve mechanisms 855 and 856. It also should be understood that, like other embodiments described herein, it may be possible to contract the expanded valve mechanisms of the embodiment of FIG. 8 by flowing a solvent, alcohol, or other substance into contact with the expanded valve mechanisms.

Based on the foregoing, it will be appreciated that the present teachings demonstrate novel approaches to channel closure and well isolation through the use of a fluid swell-able material/polymer. Polyacrylamide is but one exemplary material and other materials/polymers may also be used for this purpose. In the present instance water is but one fluid that may used to swell the matrix/polymer.

Both a low closure force designs and a high closure force designs may be adapted for use based on the teachings described herein. For example, the closure force may governed by the shape or form of the polymer in the condensed state. In an exemplary low closure force application, a convex surface of a pre-expanded valve may be used and is one of many possible shapes. A membrane may stretch/extend across the bottom of the valve chamber to form a substantially flat surface as opposed to a concave surface.

From the foregoing it will be appreciated that the structures and applications described herein provide numerous benefits/advantages. The present teachings not only provide novel means of effecting channel closure and well isolation but also demonstrate that the closure force can be adjusted by or based on the volume of expandable polymer used. Further various readily available swellable polymers can be utilized and materials may be selected that are relatively inexpensive and adaptable to fabrication processes. Additionally, the closure of channels can be engineered to be reversible as needed or desired using additional channels that deliver a de-hydrating fluid (for example alcohol) to the polymer.

Those having skill in the art would recognize numerous other configurations aside from a cylindrical or flattened tubular structure for a microfluidic device operating according to the principles of the exemplary embodiment of FIG. 8, and the configuration of the exemplary embodiment of FIG. 8 should be understood as nonlimiting.

In various embodiments described herein, hydration channels are used to deliver to the reservoirs holding a valve mechanism a substance configured either to expand or contract the expandable valve mechanisms. According to various exemplary embodiments, the flow communication between the hydration channels and the reservoirs containing the valve mechanisms may be substantially in an array of throughholes (e.g., the branch channels described in some exemplary embodiments) forming a shower head type of arrangement. The configuration (e.g., including size and number) of the throughhole array may be selected so as to achieve desired functioning of the valve mechanisms. For example, the throughholes may be configured so as to deliver a hydrating substance to the expandable valve material without having to pressurize the hydrating substance beyond what is needed to achieve initial filling of the hydration channel or channels. In this way, the use of pressure to activate the valve mechanism may be avoided.

At the same time, it may be desirable that the array of throughholes preserve enough surface area such the when the valve mechanism expands (e.g., swells) there is sufficient surface to contain and constrain the expansion. Throughholes that are too large or too small in diameter relative to the surface of the reservoir containing the valve mechanism may cause the valve mechanism to function improperly. The cross-link density of the valve material, such as, polyacrylamide, for example, may interact with the function of the valve mechanism and the surface area of the through holes. For example, a highly cross-linked polymer may not swell as much as a polymer that has less cross-linking. A polymer that is highly cross-linked also may not need as much surface area to press against to function properly (e.g., perform isolation and/or sealing). In contrast, a polymer that is less cross-linked may require much more surface area to press against to perform adequate sealing. A low level of cross linking may permit the polymer valve material to swell to a much higher degree, but also may cause the valve mechanism to be extruded through the throughholes in the array, thereby resulting in less force being applied to the membrane for the purpose of closing off a channel. It is anticipated that a range of cross-link densities and consequently a range of throughhole configurations, sizes, and arrangements may be selected depending on the particular application and desired function. Those having skill in the art would understand how to choose an appropriate throughhole configuration based on the desired valving application and/or factors including, for example, the material of the valve mechanism, the amount (e.g., volume) of valve material, the volume of the reservoir containing the valve mechanism, the degree of cross-linking of the valve material, and other factors.

For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all subranges subsumed therein. For example, a range of "less than 10" includes any and all subranges between (and including) the minimum value of zero and the maximum value of 10, that is, any and all subranges having a minimum value of equal to or greater than zero and a maximum value of equal to or less than 10, e.g., 1 to 5.

It is noted that, as used in this specification and the appended claims, the singular forms "a," "an," and "the" include plural referents unless expressly and unequivocally limited to one referent. Thus, for example, reference to "a layer" may include two or more different layers. As used herein, the term "include" and its grammatical variants are intended to be non-limiting, such that recitation of items in a list is not to the exclusion of other like items that can be substituted or added to the listed items.

Various embodiments of the teachings are described herein. The teachings are not limited to the specific embodiments described, but encompass equivalent features and methods as known to one of ordinary skill in the art. Other embodiments will be apparent to those skilled in the art from consideration of the present specification and practice of the teachings disclosed herein. It is intended that the present specification and examples be considered as exemplary only.

What is claimed is:

1. A device for distribution of a biological sample, the device comprising:

a substrate comprising a base, an additional layer and a membrane layer, the substrate defining at least one sample chamber and at least one sample channel, the at least one sample chamber and the at least one sample channel being in flow communication to flow a biological sample therebetween;

wherein the membrane layer is disposed between the base and the additional layer;

at least one valve mechanism configured to expand from a first position to a second position, the at least one valve mechanism being an expandable material contained in the additional layer;

a supply channel configured to receive a substance for expanding the expandable material, the expandable material disposed between the at least one sample channel and the supply channel;

wherein, in the first position, the at least one valve mechanism permits flow communication between the at least one sample channel and the at least one sample chamber; and wherein, in the second position, the expandable material exerts a force on the membrane layer to seal the at least one sample channel.

2. The device of claim 1, wherein the expandable material comprises an expandable polymer.

3. The device of claim 1, wherein the additional layer defines at least one reservoir configured to contain the expandable material.

4. The device of claim 3, wherein the membrane layer partially defines the at least one reservoir.

5. The device of claim 3, wherein the additional layer defines at least one additional channel in flow communication with the at least one reservoir, the at least one additional channel being configured to flow a substance into contact with the expandable material.

6. The device of claim 5, wherein the substance comprises a substance configured to one of expand the expandable material from the first position to the second position or contract the expandable material from the second position to the first position.

7. The device of claim 1, wherein, in the second position, the at least one valve mechanism is configured to exert a force on the membrane layer such that the membrane layer and the at least one valve mechanism substantially block the portion of the at least one channel.

8. The device of claim 1, wherein the at least one channel comprises a first channel and a second channel, the first channel and the second channel being in flow communication with the at least one chamber to flow biological sample therebetween.

9. The device of claim 8, wherein the at least one valve mechanism comprises a first valve mechanism configured to exert a force on the membrane layer so as to substantially block a portion of the first channel and a second valve mechanism configured to exert a force on the membrane layer so as to substantially block a portion of the second channel.

10. The device of claim 9, wherein the first valve mechanism and the second valve mechanism are configured to expand independently from each other.

11. The device of claim 9, wherein the first valve mechanism and the second valve mechanism are configured to exert differing forces on the membrane layer in the second position.

12. The device of claim 9, further comprising a mechanism for displacing biological sample from the at least one sample chamber into the outlet channel past the second valve mechanism, the mechanism causing the second valve mechanism to move so as to open the portion of the outlet channel when the second valve mechanism is in the second position.

13. The device of claim 12, wherein the mechanism for displacing biological sample comprises one of a mechanical and a chemical mechanism configured to increase pressure in the at least one sample chamber.

14. The device of claim 9, wherein the first valve mechanism and the second valve mechanism are independently actuatable.

15. The device of claim 1, further comprising at least one transfer valve mechanism expandable between a first position wherein the at least one transfer valve mechanism is disposed external to the at least one sample chamber and a second position wherein the at least one transfer valve mechanism occupies at least a portion of the at least one sample chamber.

16. The device of claim 15, wherein in the second position, the at least one transfer valve mechanism is configured to displace biological sample from the at least one sample chamber.

17. The device of claim 16, wherein the at least one channel comprises an inlet channel configured to flow biological sample to the at least one sample chamber and an outlet channel configured to flow biological sample from the at least one sample chamber, and wherein, in the second position, the at least one transfer valve mechanism is configured to displace biological sample from the at least one chamber and into the outlet channel.

18. The device of claim 17, wherein the at least one valve mechanism comprises a first valve mechanism configured to exert a force on the membrane layer so as to substantially block a portion of the inlet channel and a second valve mechanism configured to exert a force on the membrane layer so as to substantially block a portion of the outlet channel, the first valve mechanism and the second valve mechanism being independently actuatable.

19. The device of claim 18, wherein the at least one chamber comprises a plurality of chambers connected in series via inlet and outlet channels, each inlet and outlet channel being associated with a valve mechanism.

20. The device of claim 19, wherein the at least one transfer valve mechanism comprises a plurality of transfer valve mechanisms, each transfer valve mechanism being associated with a respective chamber.

21. The device of claim 20, wherein the valve mechanisms and the transfer valve mechanisms comprise an expandable polymer.

22. The device of claim 21, wherein the substrate further defines a network of hydration channels configured to flow a substance into contact with the valve mechanisms and transfer valve mechanisms so as to independently expand or contract the valve mechanisms and the transfer valve mechanisms.

23. The device of claim 1, wherein the at least one chamber comprises a plurality of chambers and the at least one channel comprises a respective inlet channel and a respective outlet channel in flow communication with each chamber, and wherein the at least one valve mechanism comprises a respective valve mechanism associated with each of the inlet channels and outlet channels and configured to exert a force on the membrane layer so as to substantially block a portion of the inlet channels and outlet channels.

24. The device of claim 23, wherein the valve mechanisms associated with the inlet channels are configured to be independently actuatable from the valve mechanisms associated with the outlet channels.

25. The device of claim 23, further comprising a first hydration channel configured to flow a substance in contact with the valve mechanisms associated with the inlet channels to one of expand and contract the valve mechanisms associated with the inlet channels and a second hydration channel configured to flow a substance in contact with the valve mechanisms associated with the outlet channels to one of expand and contract the valve mechanisms associated with the outlet channels.

26. The device of claim 23, wherein at least some of the plurality of sample chambers are configured to be loaded in series with biological sample.

27. The device of claim 23, wherein at least some of the plurality of sample chambers are configured to be loaded in parallel with biological sample.

28. A method for distributing a biological sample, the method comprising:

supplying the biological sample to a substrate comprising a base, an additional layer and a membrane layer, the substrate defining at least one sample chamber and at least one sample channel, the at least one sample chamber and the at least one sample channel being in flow communication to flow biological sample therebetween, wherein the additional layer defines at least one reservoir configured to contain the expandable material and at least one additional channel in flow communication with the at least one reservoir, and flowing the substance into contact with the expandable material comprises flowing the substance via the at least one additional channel;

flowing a substance through a supply channel;

bringing the substance into contact with a material disposed within at least one valve mechanism in the additional layer;

upon contact of the substance with the material, expanding the material such that the at least one valve mechanism moves from a first position, wherein the valve mechanism permits flow communication between the at least one sample channel and the at least one sample chamber, to a second position, wherein the at least one valve mechanism is configured to exert a force on the membrane layer so as to substantially block a portion of the at least one sample channel to prevent the biological sample from flowing past the valve mechanism.

29. The method of claim 28, wherein the at least one valve mechanism comprises an expandable material and expanding the at least one valve mechanism comprises flowing a substance into contact with the expandable material.

30. The method of claim 29, wherein the expandable material comprises an expandable polymer.

31. The method of claim 29, further comprising flowing another substance into contact with the expandable material to contract the expandable material from the second position to the first position.

32. The method of claim 28, wherein expanding the at least one valve mechanism to the second position comprises exerting a force on the membrane layer such that the membrane layer and the at least one valve mechanism block the portion of the at least one channel.

33. The method of claim 28, wherein the at least one channel comprises an inlet channel and an outlet channel in flow communication with the at least one chamber to flow biological sample therebetween, and the at least one valve mechanism comprises a first valve mechanism configured to exert a force on the membrane layer so as to substantially block a portion of the first channel and a second valve mechanism configured to exert a force on the membrane layer so as to substantially block a portion of the second channel, and wherein expanding the first valve mechanism and the second valve mechanism comprises independently expanding the first valve mechanism and the second valve mechanism.

34. The method of claim 33, wherein expanding the first valve mechanism and the second valve mechanism to the second position comprises exerting differing forces on the membrane layer by the first valve mechanism and the second valve mechanism.

35. The method of claim 34, further comprising displacing biological sample from the at least one sample chamber into the outlet channel past the second valve mechanism.

36. The method of claim 35, wherein displacing the biological sample comprises moving the second valve mechanism so as to open the portion of the outlet channel when the second valve mechanism is in the second position.

37. The method of claim 35, wherein displacing the biological sample comprises increasing pressure in the at least one sample chamber via one of a mechanical mechanism and a chemical mechanism.

38. The method of claim 28, further comprising expanding at least one transfer valve mechanism from a first position wherein the at least one transfer valve mechanism is disposed external to the at least one sample chamber to a second position wherein the at least one transfer valve mechanism occupies at least a portion of the at least one sample chamber.

39. The method of claim 38, further comprising displacing biological sample from the at least one sample chamber when the transfer valve mechanism is in the second position.

40. The method of claim 39, wherein displacing the biological sample comprises displacing the biological sample from the at least one chamber to an outlet channel in flow communication with the at least one sample chamber.

41. The method of claim 38, wherein the at least one transfer valve mechanism comprises an expandable material and wherein expanding the at least one transfer valve mechanism comprises flowing a substance in contact with the expandable material to expand the expandable material.

42. The method of claim 28, wherein the at least one chamber comprises a plurality of chambers and the at least one channel comprises an inlet channel and an outlet channel in flow communication with each of the chambers respectively, and wherein expanding the at least one valve mechanism comprises expanding a plurality of valve mechanisms respectively associated with each of the inlet channels and outlet channels to exert a force on the membrane layer so as to substantially block a portion of the inlet channels and outlet channels.

43. The method of claim 42, wherein the expanding the valve mechanisms comprises independently expanding the valve mechanisms.

44. The method of claim 43, further comprising flowing biological sample to at least some of the plurality of sample chambers in series.

45. The method of claim 42, further comprising flowing biological sample to at least some of the plurality of sample chambers in parallel.

46. A device for distribution of a biological sample, the device comprising:

a first substrate comprising a base and a membrane layer, the base and the membrane layer defining at least one sample chamber connected to at least one sample channel;

a second substrate defining a reservoir;

an expandable material disposed within the reservoir;

a supply channel configured to receive a substance for expanding the expandable material, the supply channel being void of the expandable material;

a first material condition in which the expandable material allows flow communication between the at least one sample chamber and the at least one sample channel; and a second material condition in which the expandable material exerts a force against the membrane to seal the at least one sample channel.

47. The device of claim 46, wherein the reservoir comprises one or more branch channels connecting the reservoir to the supply channel.

* * * * *

UNITED STATES PATENT AND TRADEMARK OFFICE

CERTIFICATE OF CORRECTION

PATENT NO. : 8,337,777 B2
APPLICATION NO. : 11/768138
DATED : December 25, 2012
INVENTOR(S) : Nurse et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 902 days.

Signed and Sealed this
Twenty-eighth Day of October, 2014

Michelle K. Lee

Michelle K. Lee
*Deputy Director of the United States Patent and Trademark Office*